US009004484B2

(12) United States Patent
Murakami

(10) Patent No.: US 9,004,484 B2
(45) Date of Patent: Apr. 14, 2015

(54) SHEET-MEDIUM CONVEYING DEVICE AND IMAGE FORMING APPARATUS

(71) Applicant: Oki Data Corporation, Tokyo (JP)

(72) Inventor: Tatsuya Murakami, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 13/665,277

(22) Filed: Oct. 31, 2012

(65) Prior Publication Data

US 2013/0106043 A1 May 2, 2013

(30) Foreign Application Priority Data

Oct. 31, 2011 (JP) ..... 2011-238522

(51) Int. Cl.
*B65H 1/04* (2006.01)

(52) U.S. Cl.
CPC ..... *B65H 1/04* (2013.01); *B65H 2405/11* (2013.01); *B65H 2405/1111* (2013.01); *B65H 2405/1122* (2013.01); *B65H 2405/32* (2013.01); *B65H 2405/11164* (2013.01); *B65H 2405/324* (2013.01); *B65H 2407/21* (2013.01)

(58) Field of Classification Search
CPC ..... B65H 1/00; B65H 1/04; B65H 1/266; B65H 2405/10; B65H 2405/11; B65H 2405/111; B65H 2405/1111; B65H 2405/1112; B65H 2405/11152; B65H 2405/1116; B65H 2405/11161; B65H 2405/11162; B65H 2405/11163; B65H 2405/11164; B65H 2405/112; B65H 2405/1122; B65H 2405/1124; B65H 2405/113; B65H 2405/1132; B65H 2405/1134; B65H 2405/1136; B65H 2407/32; B65H 2407/324
USPC ..... 271/145, 147, 162, 160, 9.09; 399/392, 399/393
See application file for complete search history.

(56) References Cited

U.S. PATENT DOCUMENTS

| | | | | |
|---|---|---|---|---|
| 3,921,972 | A * | 11/1975 | Miller | 271/171 |
| 5,175,583 | A * | 12/1992 | Noh et al. | 399/107 |
| 6,073,925 | A * | 6/2000 | Sato | 271/171 |
| 6,890,071 | B2 * | 5/2005 | Khormaei et al. | 347/104 |
| 7,070,350 | B2 * | 7/2006 | Inokuchi et al. | 400/680 |
| 7,410,164 | B2 * | 8/2008 | Koide et al. | 271/213 |
| 7,594,720 | B2 * | 9/2009 | Kawakami et al. | 347/104 |
| 7,748,691 | B2 * | 7/2010 | Mizuguchi | 271/9.09 |

(Continued)

FOREIGN PATENT DOCUMENTS

| | | |
|---|---|---|
| EP | 0 866 598 A1 | 9/1998 |
| JP | 08-81092 | 3/1996 |

(Continued)

*Primary Examiner* — Ernesto Suarez
(74) *Attorney, Agent, or Firm* — Rabin & Berdo, P.C.

(57) ABSTRACT

An image forming apparatus includes a sheet-medium conveying device, which has a first sheet-medium stacker part provided on a casing so as to be capable of being opened from and closed to the casing; a second sheet-medium stacker part provided on the first sheet-medium stacker part so as to be capable of being drawn from and inserted into the first sheet-medium stacker part; and an auxiliary member provided on the first sheet-medium stacker part so as to be capable of being moved, the auxiliary member being engaged with the second sheet-medium stacker part so as to be moved together with the drawing of the second sheet-medium stacker part so that the auxiliary member covers a gap portion between the main sheet-medium stacker surface and the expanded sheet-medium stacker surface when the second sheet-medium stacker part is in a drawn state.

17 Claims, 31 Drawing Sheets

(56) References Cited

U.S. PATENT DOCUMENTS

| | | | | |
|---|---|---|---|---|
| 7,815,304 | B2 * | 10/2010 | Ahn | 347/108 |
| 8,297,614 | B2 * | 10/2012 | Takeuchi et al. | 271/162 |
| 2005/0052517 | A1 * | 3/2005 | Fujioka et al. | 347/104 |
| 2007/0222136 | A1 * | 9/2007 | Murakami | 271/9.09 |
| 2008/0048384 | A1 * | 2/2008 | Kusama | 271/145 |
| 2013/0164064 | A1 * | 6/2013 | Matsumoto | 399/361 |

FOREIGN PATENT DOCUMENTS

| | | |
|---|---|---|
| JP | 2004-137078 A | 5/2004 |
| JP | 2007-254074 | 10/2007 |
| JP | 2011-111271 | 6/2011 |

* cited by examiner

SHEET-MEDIUM CONVEYING DEVICE AND IMAGE FORMING APPARATUS

BACKGROUND OF THE INVENTION

1. Field of the Invention

The present invention relates to a sheet-medium conveying device and an image forming apparatus.

2. Description of the Related Art

In a conventional art, a sheet-medium cassette is mounted at a lower part in a main body (also referred to as an "apparatus main body") of an image forming apparatus such as a color printer, and a sheet medium such as a sheet paper fed from the sheet-medium cassette is conveyed through a conveyance route along a plurality of image forming units. Toner images of different colors are formed on photosensitive drums of the image forming units respectively, the toner images are transferred from the photosensitive drums to the sheet medium, and then the toner images are fixed on the sheet medium by a fixing unit. As a result, a color image is formed on the sheet medium. Thereafter, the sheet medium is conveyed and then ejected from the apparatus main body onto an output stacker.

Further, in order to feed a special-purpose sheet medium such as a thin sheet paper, a thick sheet paper, a postcard and an envelope, the image forming apparatus may have a sheet-medium feed tray as a sheet-medium conveying device for feeding a sheet medium, which is provided on a side wall or another location of the apparatus main body so as to be capable of being opened from and closed to the apparatus main body. Refer to Japanese Patent Application Kokai Publication No. 2004-137078 (Patent Document 1), for example. Furthermore, in order to eject the special-purpose sheet medium, on which a color image has already been formed, the image forming apparatus may have a sheet-medium output tray as a sheet-medium conveying device for ejecting a sheet medium, which is provided on a side wall or another location of the apparatus main body so as to be capable of being opened from and closed to the apparatus main body.

In the sheet-medium feed tray and the sheet-medium output tray, a sheet-medium stacker surface on which special-purpose sheet media are to be stacked is formed by opening a main tray and unfolding an auxiliary tray by a user. However, when folding the auxiliary tray and closing the main tray, a user sometimes feels cumbersome.

To avoid such situations, there is a proposal that a main body of an image forming apparatus has a device including a main tray is opened or closed by opening or closing a sheet-medium feed tray (or a sheet-medium output tray) and an auxiliary tray which can be drawn from and inserted into the main tray. In such a sheet-medium feed tray (or a sheet-medium output tray), the auxiliary tray can be inserted into the main tray for its accommodation without moving guide members for guiding side edges of the auxiliary tray to the outside of side edges of the auxiliary tray.

However, there are problems that when a sheet medium is put on the sheet-medium stacker surface formed by a combination of the main tray and the auxiliary tray, a tip (i.e., a front end) of the sheet medium abuts against a step portion or a gap portion formed between the main tray and the auxiliary tray, thus resulting in that the sheet medium cannot be smoothly set on the sheet-medium stacker surface and that the front end of the sheet medium tends to be easily folded, buckled or damaged.

SUMMARY OF THE INVENTION

An object of the present invention is to provide a sheet-medium conveying device which can be easily accommodated in a main body of an image forming apparatus and can allow a sheet medium to be smoothly set on a sheet-medium stacker surface, and to provide an image forming apparatus having the sheet-medium conveying device.

According to an aspect of the present invention, a sheet-medium conveying device includes: a first sheet-medium stacker part provided on a casing so as to be capable of being opened from and closed to the casing, the first sheet-medium stacker part having a main sheet-medium stacker surface on which a sheet medium is to be placed, the main sheet-medium stacker surface being directed upward when the first sheet-medium stacker part is in an opened state; a second sheet-medium stacker part provided on the first sheet-medium stacker part so as to be capable of being drawn from and inserted into the first sheet-medium stacker part, the second sheet-medium stacker part having an expanded sheet-medium stacker surface on which the sheet medium is to be placed, the expanded sheet-medium stacker surface appearing by drawing the second sheet-medium stacker part from the first sheet-medium stacker part when the first sheet-medium stacker part is in the opened state; and an auxiliary member provided on the first sheet-medium stacker part so as to be capable of being moved, the auxiliary member being engaged with the second sheet-medium stacker part so as to be moved together with the drawing of the second sheet-medium stacker part so that the auxiliary member covers a gap portion between the main sheet-medium stacker surface and the expanded sheet-medium stacker surface when the second sheet-medium stacker part is in a drawn state.

According to another aspect of the present invention, an image forming apparatus includes: a casing; and a sheet-medium conveying section, wherein the sheet-medium conveying section is the above-mentioned sheet-medium conveying device.

DETAILED DESCRIPTION OF THE INVENTION

Figure 1:
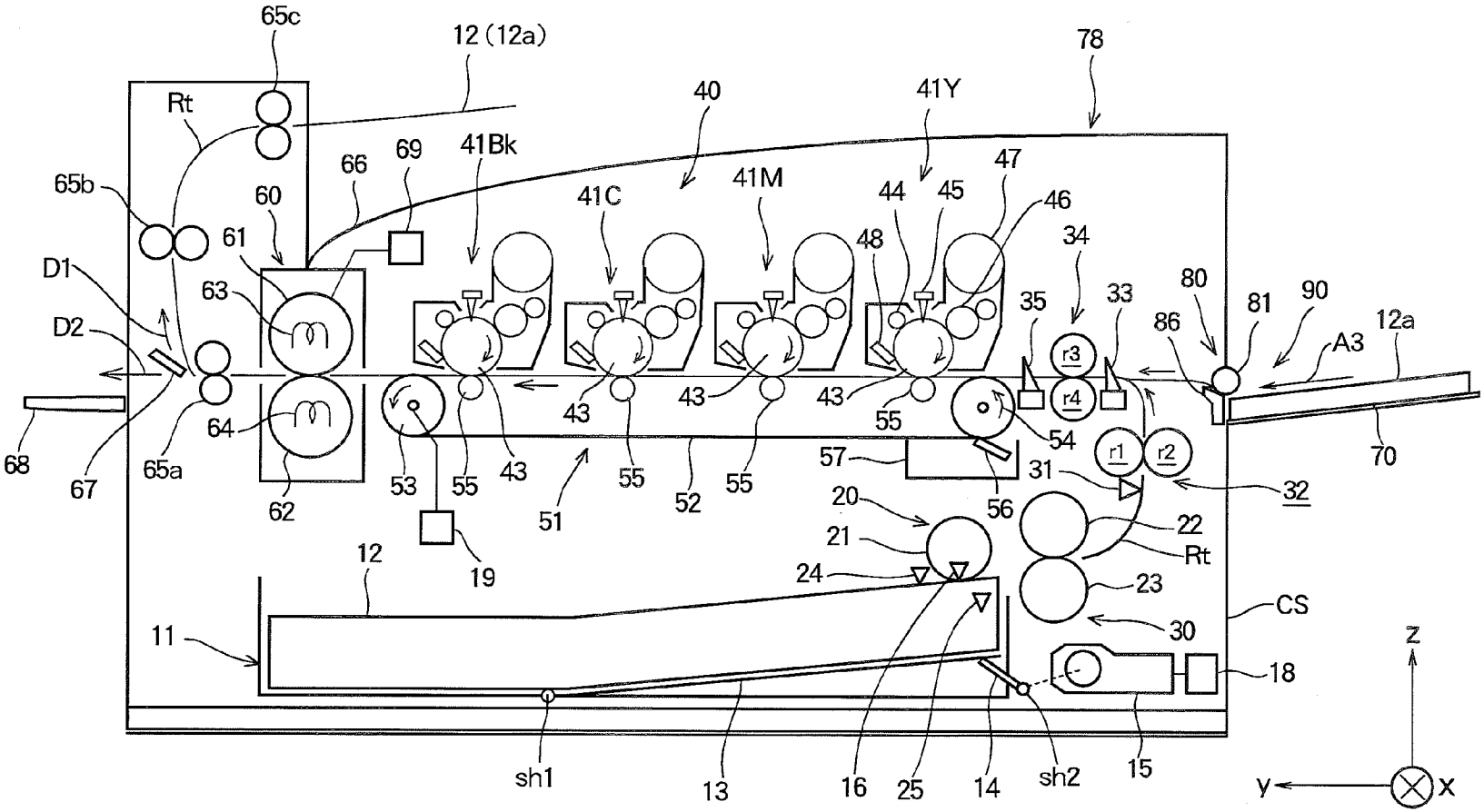
FIG. 1 is a diagram schematically showing internal structure of a color printer as an image forming apparatus according to a first embodiment of the present invention.

A detailed description will be made as to sheet-medium conveying devices and image forming apparatuses according to embodiments of the present invention, with reference to the accompanying drawings. A xyz Cartesian coordinate system is shown in each of the drawings. In the drawings, an x-axis direction denotes a depth direction of the image forming apparatus, which is substantially parallel to a direction of width of a sheet medium 12*a* such as a sheet paper (i.e., a width direction A2 shown in FIG. 4) perpendicular to a direction of feeding of the sheet medium 12*a* (i.e., a feed direction A3 shown in FIG. 1). A y-axis direction denotes the width direction A2. A z-axis direction denotes a direction of height of the image forming apparatus (i.e., a height direction), which is substantially parallel to a vertical direction. A tip of the sheet medium 12*a* (illustrated as a left side of the sheet medium 12*a* in FIG. 1) in the feed direction A3 (i.e., y-axis direction) is also referred to as a "front end". A trailing end of the sheet medium 12*a* in the feed direction of the sheet medium 12*a* is also referred to as a "rear end".

First Embodiment

FIG. 1 is a diagram schematically showing internal structure of a color printer as an image forming apparatus according to a first embodiment.

As shown in FIG. 1, a sheet-medium cassette 11 forming a part of a first sheet-medium conveying device is provided at a lower part inside a main body (apparatus main body) 78 of the color printer so that the sheet-medium cassette 11 can be attached to and detached from the apparatus main body 78. The first sheet-medium conveying device has a function of a first sheet-medium feed unit. Sheet media 12 such as sheet papers are accommodated in the sheet-medium cassette 11. A sheet-medium stacker plate 13 is provided in the sheet-medium cassette 11 so as to be capable of being swung or rotated about a rotation shaft sh1 as a rotation center axis. The sheet media 12 are stacked on the sheet-medium stacker plate 13 in the sheet-medium cassette 11.

Guide members for regulating a position of the stacked sheet media 12 are provided in the sheet-medium cassette 11. The guide members guide side edges of the sheet media 12 so as to determine position of the sheet media 12 in a direction perpendicular to the feed direction (conveyance direction) of the sheet media 12.

A lift-up lever 14 is provided in the sheet-medium cassette 11 at a feeding side of the sheet medium 12, that is, at a side of the front end of the sheet medium 12 so as to be capable of being swung or rotated about a shaft sh2 as a rotation center axis. The shaft sh2 is detachably coupled to a rotary shaft of a motor 15 provided in the apparatus main body 78 as a driver unit for feeding the sheet medium 12. When the sheet-medium cassette 11 are loaded or inserted in a casing CS (which is a part of the apparatus main body 78) to be set in the apparatus main body 78, the lift-up lever 14 is engaged with the rotary shaft of the motor 15.

When a controller 18 drives the motor 15, the lift-up lever 14 is rotated so that a tip of the lift-up lever 14 abuts against a bottom wall of the sheet-medium stacker plate 13 and lifts up a front end part of the sheet-medium stacker plate 13, whereby the front end of the sheet medium or media 12 stacked on the sheet-medium stacker plate 13 is moved up. When the front end of the sheet medium or media 12 is moved up to a predetermined height, a move-up detector 16 detects the sheet media 12 to generate a detection signal and sends the detection signal to the controller 18. Furthermore, when receiving the detection signal, the controller 18 stops the motor 15 to stop rotation of the lift-up lever 14.

A sheet-medium pick-up feeder 20 for feeding the sheet medium 12 one by one is provided in the vicinity of the front end part of the sheet-medium cassette 11. The sheet-medium cassette 11 and the sheet-medium pick-up feeder 20 form a first sheet-medium feed mechanism 30.

The sheet-medium pick-up feeder 20 has a pickup roller 21, feed rollers 22 and 23, a sheet-medium presence/absence detector 24, and a sheet-medium remaining quantity detector 25. The pickup roller 21 is provided so as to push the front end of the sheet medium 12 which is moved up as far as the predetermined height. The pickup roller 21 is a member for feeding the sheet medium 12 in the sheet-medium cassette 11. The feed rollers 22 and 23 form a device for separating the sheet medium 12. The feed roller 22 is provided to separate a single sheet medium from the sheet medium or media 12 that are picked up and fed by the pickup roller 21. The feed roller 22 functions as a first separation roller, and the feed roller 23 functions as a second separation roller. The sheet-medium presence/absence detector 24, which is disposed to be adjacent to the move-up detector 16, detects the presence or absence of the sheet medium 12. The sheet-medium remaining quantity detector 25, which is disposed at a position lower by a predetermined distance than the move-up detector 16, detects remaining quantity of the sheet medium 12.

The sheet medium 12 fed by the sheet-medium pick-up feeder 20 and separated by the feed rollers 22 and 23 is conveyed along a sheet-medium conveyance route Rt and passes through a sheet-medium sensor 31 as a first sheet-medium detector. After that, the front end of the sheet medium 12 is detected by the sheet-medium sensor 31, and then the sheet medium 12 is conveyed to a conveyance roller pair 32 as a first roller pair of rollers r1 and r2. When the sheet-medium sensor 31 detects the front end of the sheet medium 12 to generate a detection signal, it sends the detection signal to the controller 18.

Subsequently, the sheet medium 12 conveyed by the conveyance roller pair 32 passes through a detection position of an inlet sensor 33 as a second sheet-medium detector, the front end of the sheet medium 12 is detected by the inlet sensor 33, the sheet medium is then conveyed to a resist roller pair 34 as a second roller pair of rollers r3 and r4 to correct a skew of the sheet medium 12. In this case, for example, one of the rollers r3 and r4 of the resist roller pair 34 has a surface made of a member having a high friction material such as rubber, and the other roller has a surface made of a member having a low friction material such as a metal or a plastic, which has a lower friction coefficient than the high friction material.

The sheet medium 12 fed from the resist roller pair 34 passes through a detection position of a write sensor 35 as a third sheet-medium detector, the front end of the sheet medium 12 is detected by the write sensor 35, and then conveyed to an image forming section 40.

In the first embodiment, the inlet sensor 33 is disposed upstream of the resist roller pair 34 in the conveyance direction of the sheet medium 12 and in the vicinity of the resist roller pair 34. The write sensor 35 is disposed downstream of the resist roller pair 34 in the conveyance direction of the sheet medium 12 and in the vicinity of the resist roller pair 34. When the inlet sensor 33 detects the front end of the sheet medium 12 to generate a detection signal, it sends the detection signal to the controller 18.

The image forming section 40 has image forming units 41Y, 41M, 41C and 41Bk of colors of yellow, magenta, cyan and black arranged in series, and also has a transfer unit 51 as a transfer device for transferring toner images as developer images formed by the image forming units 41Y, 41M, 41C and 41Bk onto the sheet medium 12 (or 12*a*) by Coulomb force. The image forming section 40 forms an image such as a color image on the sheet medium 12 (or 12*a*).

Each of the image forming units 41Y, 41M, 41C and 41Bk has, for example, a photosensitive drum 43 such as an organic photo conductor (OPC) drum, a charging roller 44, a developing roller 46, a toner supplier 47, and a cleaning blade 48. The photosensitive drum 43 is an image carrier for carrying a toner image on a surface of the photosensitive drum 43. The charging roller 44 is an electrically charging device for electrically charging the surface of the photosensitive drum 43 uniformly. The developing roller 46 is a developer carrier for forming toner images of the respective colors to electrostatic latent images formed as latent images on the surface of the photosensitive drum 43. The toner supplier 47 supplies toners of the respective colors as developers to the surface of the photosensitive drums 43 of the image forming units 41Y, 41M, 41C and 41Bk. The cleaning blade 48 is a first cleaning member for removing toners remaining on the surface of the photosensitive drum 43.

In the first embodiment, in order to form an electrostatic latent image by exposing the surface of the photosensitive drum 43 electrically charged by the charging roller 44 to light, an LED head 45 functioning as an exposing device (a printing head) is disposed above the photosensitive drum 43 to be opposed to the photosensitive drum 43. Each LED head 45 has an LED array. The exposure device may use a light source (e.g., laser light source) other than the LED.

The transfer unit 51 has a conveyance motor 19 as a conveyance driver, a drive roller 53, a tension roller 54, a transfer belt 52, a transfer roller 55, a cleaning blade 56, and a discard toner box 57, for example. The drive roller 53 is rotated together with driving of the conveyance motor 19. The tension roller 54 is rotatably disposed to be spaced from the drive roller 53 by a predetermined distance. The transfer belt 52 is an endless belt which is extended between the drive roller 53 and the tension roller 54. The transfer belt 52 is run by rotation of the drive roller 53 to electrostatically attract the sheet medium 12 or 12*a* to convey it. The transfer roller 55 is a transfer member which is provided to be opposed to the associated one of the image forming units 41Y, 41M, 41C and 41Bk so that the transfer belt 52 is provided between the transfer rollers 55 and the image forming units 41Y, 41M, 41C and 41Bk. The transfer belt 52 is disposed so as to push against the photosensitive drum 43 in order to transfer a toner image to the sheet medium 12. The cleaning blade 56 is a second cleaning member which removes the toners attached to the outside surface of the transfer belt 52 by scrapping the belt. The discard toner box 57 is a discard developer container which receives and accumulates toners (i.e., discarded toners) scrapped by the cleaning blade 56.

The formation of toner images of respective colors associated with the image forming units 41Y, 41M, 41C and 41Bk is synchronized with the running of the transfer belt 52, so that the toner images of respective colors are successively transferred onto the sheet medium 12 or 12*a* placed on the transfer belt 52 to be overlapped with each other, thus forming a color toner image. In this manner, the sheet medium 12 or 12*a* having the color toner image formed thereon is conveyed to a fixing unit 60 as a fixing device.

The fixing unit 60 includes a roller pair having an upper roller 61 as a first roller, a surface of which is made of a resilient material, and a lower roller 62 as a second roller, for example. A halogen lamp 63 as a first heat source is provided in the upper roller 61, and a halogen lamp 64 as a second heat source is provided in the lower roller 62. The upper roller 61 is rotated by driving a fixing motor 69 as a fixing driver. The color toner image is fixed onto the sheet medium 12 or 12*a* in the fixing unit 60 by heating and compressing the sheet medium. In this connection, the structure of the fixing unit 60 is not limited to the aforementioned example.

The sheet medium 12 or 12*a*, on which the color image has been formed, is conveyed by eject roller pairs 65*a*, 65*b* and 65*c* provided in the sheet-medium conveyance route Rt, is ejected from the apparatus main body 78, and is stacked on a stacker 66, which is formed on an upper surface of the apparatus main body 78.

It is desirable that a separator 67 as a conveyance route switching device be provided in the color printer of the first embodiment to be adjacent to the eject roller pair 65*a*. The separator 67 can switch an eject direction of the sheet medium 12 or 12*a* having the color image formed thereon to an upper direction (z-axis direction in FIG. 1) or to a straight direction which is the same direction (y-axis direction in FIG. 1) as the sheet-medium eject direction. When the eject direction is the upward direction, the sheet medium 12 or 12*a* is stacked in the stacker 66 formed on the upper surface of the apparatus main body 78. When the eject direction is the straight direction, the sheet medium 12 or 12*a* is ejected from the apparatus main body 78 to be stacked in a sheet-medium output tray 68 as a sheet-medium conveying device used for receiving the sheet medium. The sheet-medium output tray 68 as a sheet-medium output unit is provided in the apparatus main body 78 so as to be capable of being swung or rotated so that the sheet-medium output tray 68 can be opened from and closed to the apparatus main body 78 in a side surface of the apparatus main body 78.

To enable feed of the sheet medium 12*a* which cannot be supplied from the sheet-medium cassette 11, such as a thin sheet paper, a thick sheet paper, a narrow sheet paper, a long sheet paper, a postcard and an envelope, and conveyance of the sheet medium 12*a* to the image forming section 40; a sheet-medium feed tray 70 as a second sheet-medium conveying device for feeding a sheet medium 12*a* as a second sheet-medium feed unit is provided in a side surface of the apparatus main body 78. The second sheet-medium conveying device is provided so as to be capable of being accommodated in the frame FR as a support member, which is a part of the casing CS. The second sheet-medium conveying device is provided in the apparatus main body 78 so as to be capable of being swung or rotated so that the second sheet-medium conveying device can be opened from and closed to the apparatus main body 78 in a direction of an arrow A1. The sheet-medium feed tray 70 functions as a multi-purpose tray (MPT) or a manual feed tray which can be opened from the apparatus main body 78 when used, and which can be closed to the apparatus main body 78 when not used.

Figure 2:
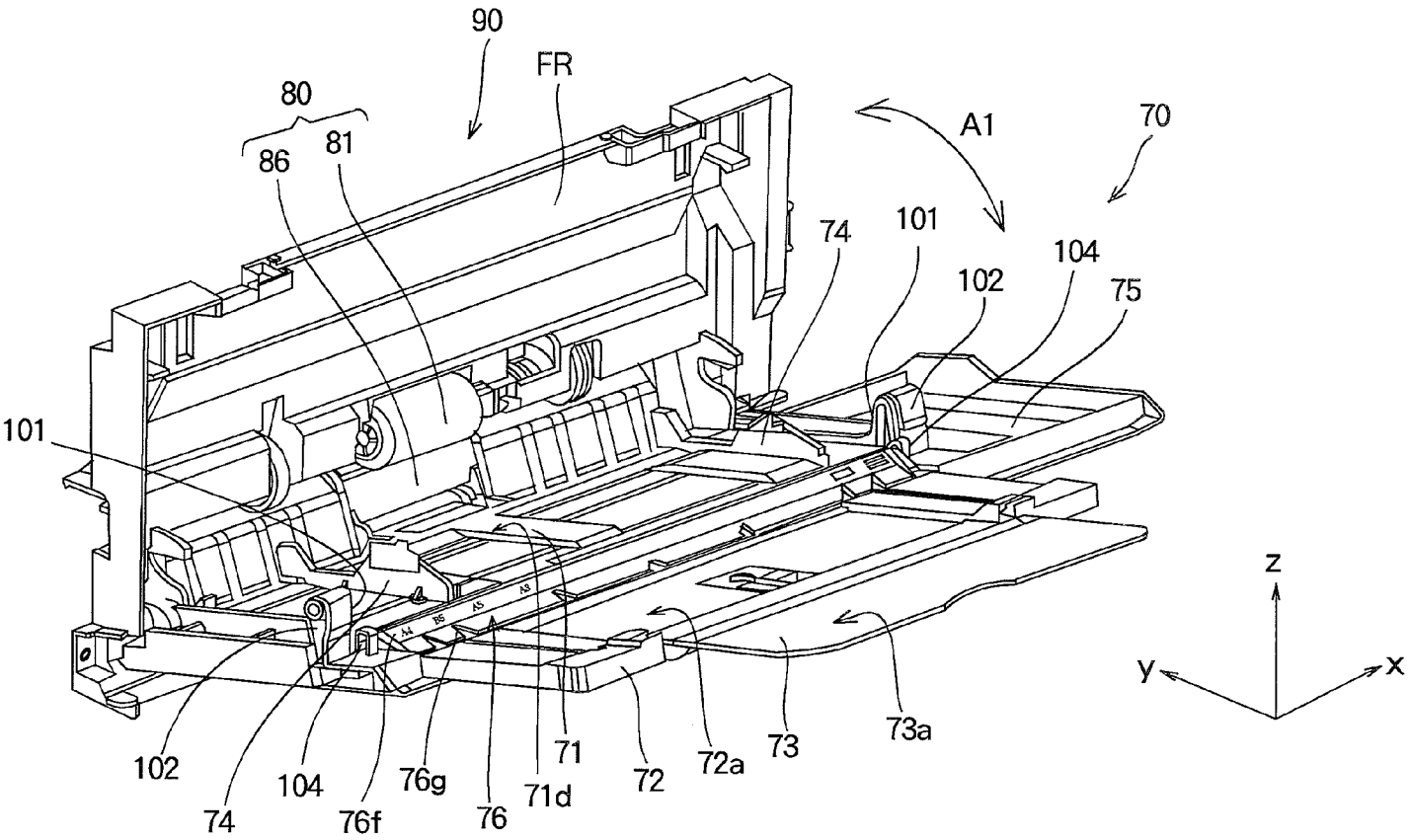
FIG. 2 is a perspective view schematically showing structure of a second sheet-medium feed mechanism in the first embodiment.
Figure 3:
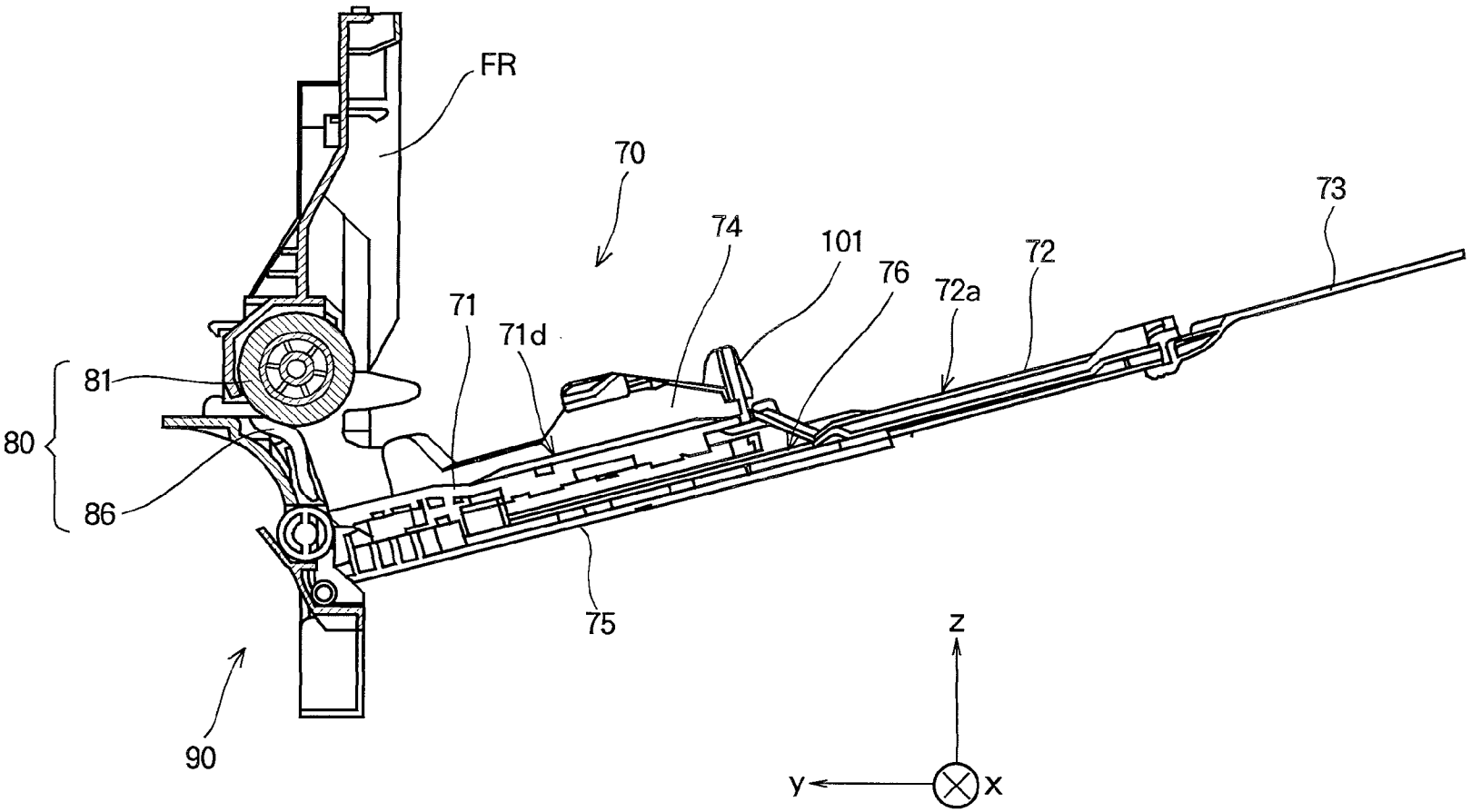
FIG. 3 is a diagram schematically showing a cross-sectional view of the second sheet-medium feed mechanism in the first embodiment.
Figure 4:
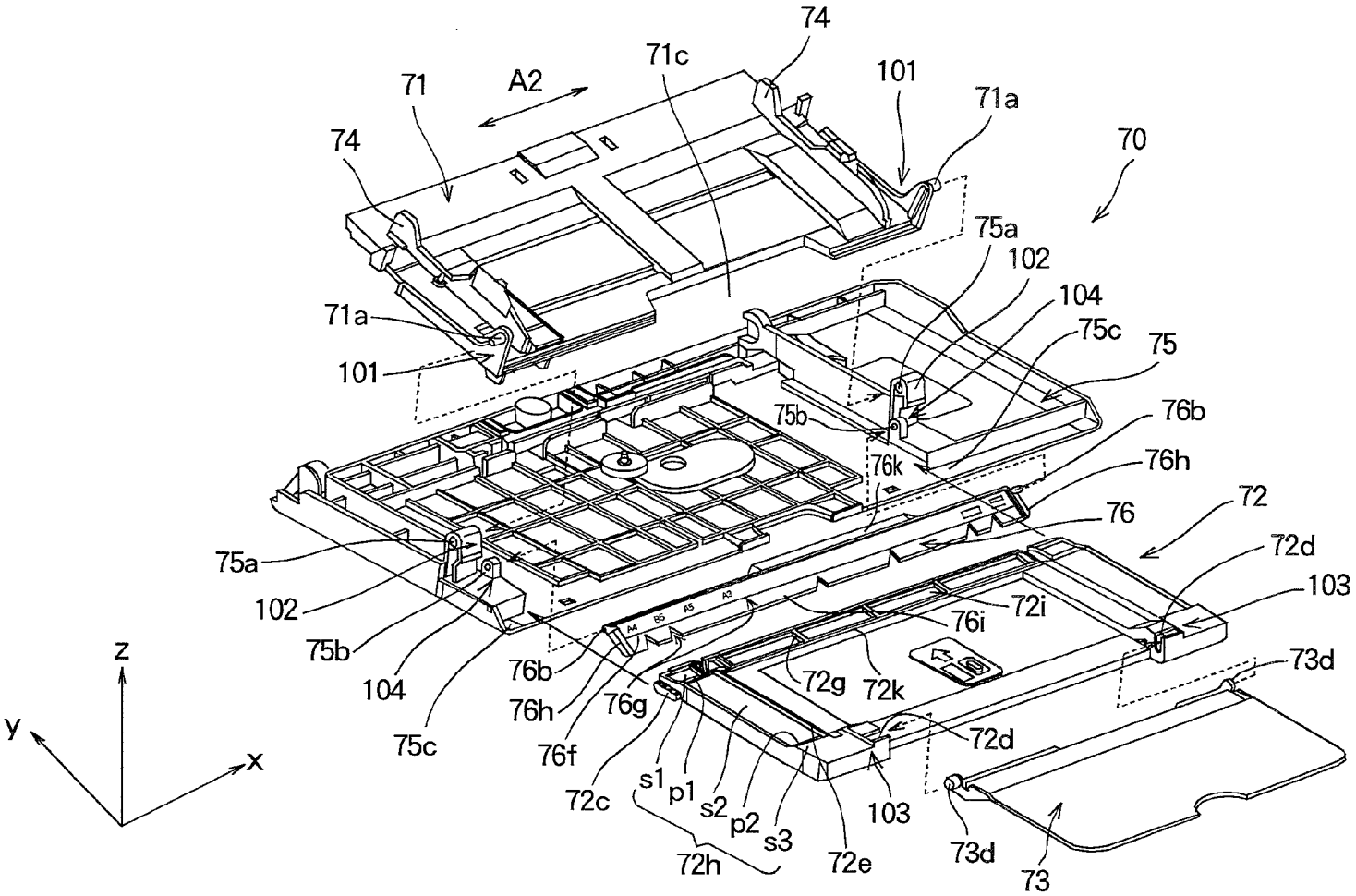
FIG. 4 is an exploded perspective view schematically showing structure of a sheet-medium feed tray in the first embodiment.

The sheet-medium feed tray 70 includes a main tray 71 and a plurality of auxiliary trays, as illustrated in FIGS. 2 to 4 to be described later. In the first embodiment, the auxiliary trays include a first auxiliary tray 72 and a second auxiliary tray 73, as illustrated in FIGS. 2 to 4. In this embodiment, although the auxiliary trays include two auxiliary trays, the number of the auxiliary trays is one or more than two.

A sheet-medium pick-up feeder 80 for repetitively feeding the sheet medium 12*a* one by one is provided in the vicinity of a front end part of the sheet-medium feed tray 70. The sheet-medium pick-up feeder 80 has a pickup roller 81 and a separating piece 86. The pickup roller 81 is a feed roller or a feed member which is provided to push the front end of the sheet medium 12*a* that is raised up to a predetermined height and to feed the sheet medium 12*a*. The separating piece 86 is a member which separates the sheet medium 12*a* supplied by the pickup roller 81 successively into a single sheet. The sheet-medium feed tray 70 and the sheet-medium pick-up feeder 80 form a second sheet medium output mechanism. The separating piece 86 forms a device for separating the sheet medium 12*a*.

In this connection, in place of the separating piece 86 as the a device for separating the sheet medium 12*a*, a feed roller as a first separation roller and a retard roller as a second separation roller may be used. A sheet-medium presence/absence detector for detecting presence or absence of the sheet medium 12*a* and a sheet-medium remaining quantity detector for detecting remaining quantity of the sheet medium 12*a* may be provided in the sheet-medium pick-up feeder 80.

The sheet medium 12*a* fed by the sheet-medium pick-up feeder 80 and separated by the separating piece 86 is conveyed to the sheet-medium conveyance route Rt.

Figure 5:
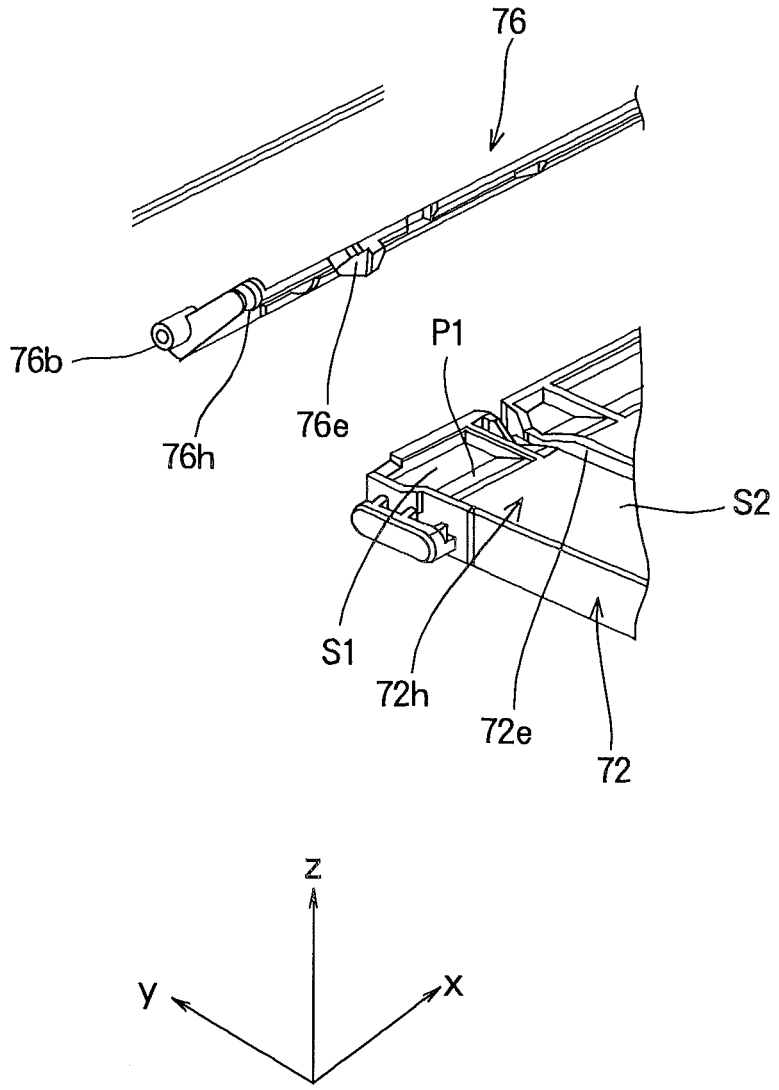
FIG. 5 is an exploded perspective view schematically showing a major part of the structure of the sheet-medium feed tray in the first embodiment.

Explanation will next be made as to a second sheet-medium feed mechanism 90. FIG. 2 is a perspective view schematically showing structure of the sheet-medium feed mechanism 90 in the first embodiment, and FIG. 3 is a cross-sectional view schematically showing structure of the sheet-medium feed mechanism 90. FIG. 4 is an exploded perspective view schematically showing structure of the sheet-medium feed tray 70 of the sheet-medium feed mechanism 90 in the first embodiment, and FIG. 5 is a perspective view schematically showing structure of a major part of the sheet-medium feed tray 70.

Figure 24:
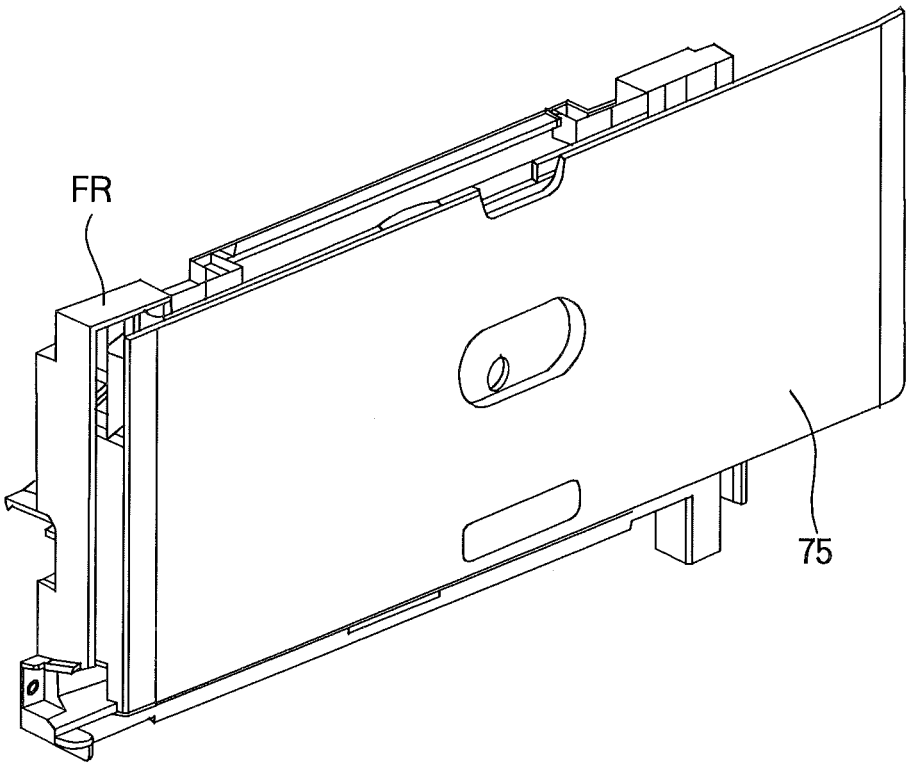
FIG. 24 is a perspective view schematically showing a sixth state of the second sheet-medium feed mechanism in the first embodiment.
Figure 24:
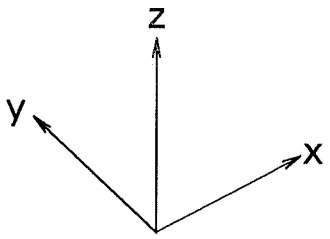
Figure 25:
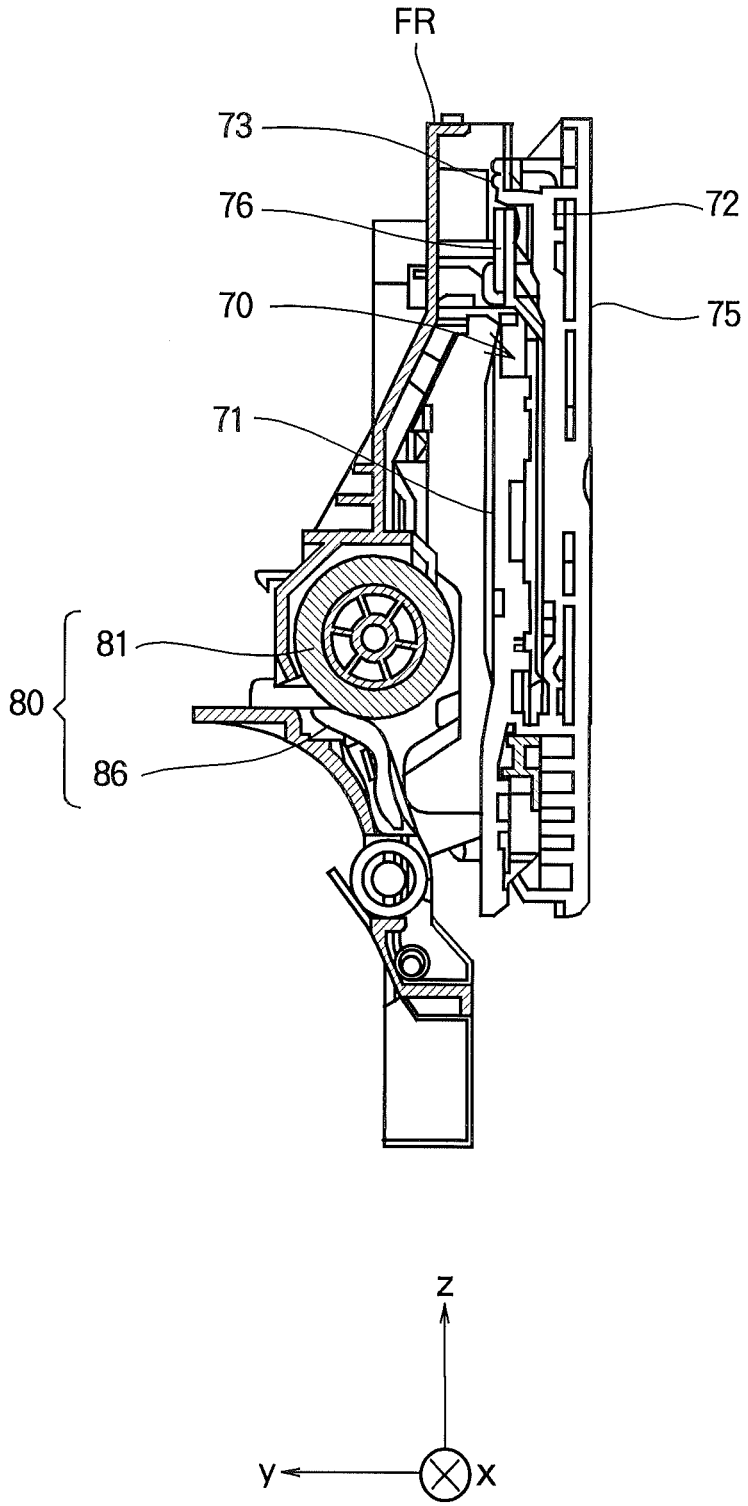
FIG. 25 is a cross-sectional view schematically showing the sixth state of the second sheet-medium feed mechanism in the first embodiment.

In FIGS. 2 to 5, reference symbol FR denotes a frame which forms a part of the casing CS of the apparatus main body 78 shown in FIG. 1. As shown in FIGS. 2 to 5, the sheet-medium feed tray 70 is provided so as to be capable of being accommodated in the frame FR of the casing CS of the apparatus main body 78. The sheet-medium feed tray 70 is provided in the apparatus main body 78 so as to be capable of being swung or rotated in a direction of an arrow A1 (FIG. 2) so that the sheet-medium feed tray 70 can be opened from and closed to the apparatus main body 78. The sheet-medium pick-up feeder 80 is provided in the frame FR of the casing CS. The sheet-medium feed tray 70 can be opened from the apparatus main body 78 by tilting the sheet-medium feed tray 70 relative to the vertical surface of the frame FR of the casing CS. The sheet-medium feed tray 70 can be closed by raising the sheet-medium feed tray 70 and overlapping it on the vertical surface of the frame FR of the casing CS (FIGS. 24 and 25 to be described later). In the sheet-medium pick-up feeder 80, the pickup roller 81 is rotatably supported by the frame FR of the casing CS and the separating piece 86 is supported by the frame FR of the casing CS so that the tip of the separating piece 86 abuts against the pickup roller 81.

As illustrated in FIGS. 2 to 5, The sheet-medium feed tray 70 as the second sheet-medium conveying device has a first sheet-medium stacker part (71, 75), a second sheet-medium stacker part 72, and an auxiliary stacker plate 76 as an auxiliary member.

The first sheet-medium stacker part (71, 75) is provided on the casing CS so as to be capable of being opened from and closed to the casing CS. The first sheet-medium stacker part (71, 75) has a main sheet-medium stacker surface 71*d* on which the sheet medium or media 12*a* are to be placed. The main sheet-medium stacker surface 71*d* is directed upward when the first sheet-medium stacker part (71, 75) is in an opened state shown in FIGS. 2 and 3, for example.

The second sheet-medium stacker part 72 is provided on the first sheet-medium stacker part (71, 75) so as to be capable of being drawn from and inserted into the first sheet-medium stacker part (71, 75). The second sheet-medium stacker part 72 has an expanded sheet-medium stacker surface 72*a* on which the sheet medium or media 12*a* are to be placed. The expanded sheet-medium stacker surface 12*a* appears by drawing the second sheet-medium stacker part 72 from the first sheet-medium stacker part (71, 75) when the first sheet-medium stacker part (71, 75) is in the opened state.

The auxiliary stacker plate 76 is provided on the first sheet-medium stacker part (71, 75) so as to be capable of being moved. The auxiliary stacker plate 76 is engaged with the second sheet-medium stacker part 72 so as to be moved together with the drawing of the second sheet-medium stacker part 72 so that the auxiliary member 76 covers a gap portion (or a step portion) between the main sheet-medium stacker surface 71*d* and the expanded sheet-medium stacker surface 72*a* when the second sheet-medium stacker part 72 is in a drawn state shown in FIGS. 2 and 3, for example.

For example, the auxiliary stacker plate 76 is provided to be rotatable relative to the first sheet-medium stacker part (71, 75). More specifically, the auxiliary stacker plate 76 is rotated by the drawing or inserting movement of the second sheet-medium stacker part 72, and when the second sheet-medium stacker part 72 is in its drawn state, an end of the auxiliary stacker plate 76 located farther from the casing CS abuts against the expanded sheet-medium stacker surface 72*a*. In the first embodiment, the first sheet-medium stacker part (71, 75) have the main tray 71 having the main sheet-medium stacker surface and a holding member 75 as an exterior cover for holding the main tray 71, which can be opened from and closed to the casing CS by the user. The auxiliary stacker plate 76 is supported by the holding member 75.

To be more specific, in the first embodiment, the sheet-medium feed tray 70 has the exterior cover 75, the main tray 71, the first auxiliary tray 72, the second auxiliary tray 73, a pair of side face guide members 74, and the auxiliary stacker plate 76, for example. The exterior cover 75 is provided to be moved (to be swung in the first embodiment) around a shaft as its swinging center relative to the frame FR of the casing CS. The exterior cover 75 is a holding member that can be opened or closed by opening or closing the sheet-medium feed tray 70. The main tray 71 is provided to be moved relative to the exterior cover 75 and the frame FR of the casing CS, and the main tray 71 can be opened or closed by opening or closing the exterior cover 75. The main tray 71 functions as a sheet-medium stacker plate on which the sheet medium or media 12*a* are to be put and has the main sheet-medium stacker surface. The first auxiliary tray 72 is provided to be drawn from the main tray 71, and has the first expanded sheet-medium stacker surface 72*a* on which the sheet medium or media 12*a* are to be put. The second auxiliary tray 73 is supported to be swung to the first auxiliary tray 72, and has a second expanded sheet-medium stacker surface 73*a* on which the sheet medium or media 12*a* are to be put. The pair of side face guide members 74 are provided to be moved in the width direction A2 (i.e., the direction of the arrow A2) of the sheet medium or media 12*a* on the main tray 71 to regulate the side edge of the sheet medium or media 12*a*. The auxiliary stacker plate 76 is provided to be moved (to be swung in the first embodiment) to the main tray 71. The auxiliary stacker plate 76 is an auxiliary member for covering the gap portion between the main tray 71 and the first auxiliary tray 72. After the sheet-medium feed tray 70 is opened, the first auxiliary tray 72 is drawn from the main tray 71 as shown in FIGS. 2 and 3, the second auxiliary tray 73 is rotatable relative to the first auxiliary tray 72 to be expanded; the sheet medium or media 12*a* can be stacked on the sheet-medium feed tray 70 under the expanded condition.

Boss supporting parts 101 as first shaft supporting parts are provided in an upright position at both edges of a rear end part of the main tray 71 (backward end of the main tray 71 in the conveyance direction of the sheet medium 12*a*). Bosses 71*a* as first shafts are provided at a top end of the boss supporting parts 101 to be projected toward the outer direction of the width of the sheet-medium feed tray 70. Shaft receiving parts 102 are provided at both edges of a rear end part of the exterior cover 75 to be projected upward. A shaft hole 75*a* is formed in an upper end of each of the shaft receiving parts 102 to be passed therethrough. Since the bosses 71*a* are inserted in a rotatable manner into the shaft holes 75*a* of the shaft receiving parts 102, the main tray 71 is supported so as to be capable of being swung or rotated relative to the exterior cover 75.

The main tray 71 takes at a depressed position (shown in FIGS. 2 and 3) to set the sheet medium or media 12*a* in the sheet-medium feed tray 70, that is, at such a sheet-medium feed position as to push the sheet medium or media 12*a* against the pickup roller 81 to feed the sheet medium 12*a*. To this end, the main tray 71 may have a spring as a pushing member for pushing the main tray 71 toward the sheet-medium feed position, a lock member for holding the main tray 71 at the depression position and for locking it when the sheet medium or media 12*a* are set in the sheet-medium feed tray 70, an operating lever for releasing the locked state of the main tray 71 by the locking member and for locating the main tray 71 at the sheet-medium feed position after the sheet medium or media 12*a* are set in the sheet-medium feed tray 70, and so on.

Bosses 72*c* as guided members projected outward in a direction of width of the sheet-medium feed tray 70 are provided at both edges of a front end part of the first auxiliary tray 72 (backward end of the first auxiliary tray 72 in the conveyance direction of the sheet medium 12*a*) to be slidable by grooved shaft receiving parts 75*c* as guides formed at both edges of the exterior cover 75. Furthermore, when the bosses 72*c* are engaged in the shaft receiving parts 75*c*, the first auxiliary tray 72 is supported so that the first auxiliary tray 72 can be drawn from and inserted into the exterior cover 75.

Bosses 73*d* as second shafts are provided to both edges of a front end part of the second auxiliary tray 73 to be projected outward in the width direction A2 of the sheet-medium feed tray 70, shaft receiving parts 103 are integrally formed with both edges of a rear end part of the first auxiliary tray 72, and a shaft hole 72*d* is made in each of the shaft receiving parts 103. Furthermore, when the bosses 73*d* are inserted in the shaft holes 72*d*, the second auxiliary tray 73 is supported to be capable of being swung or rotated relative to the first auxiliary tray 72.

By rotating the second auxiliary tray 73, the second auxiliary tray 73 can be at an expanded or opened state (shown in FIGS. 2 and 3) in which the sheet medium or media 12*a* can be put on the second auxiliary tray 73. By rotating the second auxiliary tray 73 reversely for the purpose of closing of the sheet-medium feed tray 70, the second auxiliary tray 73 can be at a folded or closed state (shown in FIGS. 10 and 11) in which the second auxiliary tray 73 is overlapped with the first auxiliary tray 72.

Bosses 76*b* as third shafts projected outward in the width direction A2 (a direction of an arrow A2) of the sheet-medium feed tray 70 are provided at both edges of a front end part of the auxiliary stacker plate 76 (an end of the auxiliary stacker plate 76 nearer to the casing CS). Shaft receiving parts 104 are provided in an upright position at both edges of a rear end part of the exterior cover 75 (located rear side of the shaft receiving parts 102, that is, farther than the shaft receiving parts 102 in the distance from the casing CS), and shaft holes 75*b* are formed in the upper ends of the shaft receiving parts 104 to be passed therethrough. Furthermore, when the bosses 76*b* are inserted in the shaft holes 75*b*, the auxiliary stacker plate 76 is supported to the exterior cover 75 so as to be capable of being swung or rotated relative to the exterior cover 75 in the first embodiment.

In order to set the sheet medium or media 12*a* in the sheet-medium feed tray 70, the main tray 71 is located at the depression position to place the sheet medium or media 12*a* on the main tray 71. At this time, if the rear end part (located farther from the casing CS) on the upper surface (main sheet-medium stacker surface) of the main tray 71 is located at a position higher than the front end part (closer from the casing CS) of the upper surface of the auxiliary stacker plate 76, then the front end (closer to the casing CS) of the sheet medium or media 12*a* may, in some cases, abut against the lateral surface of the rear end part (located farther from the casing CS) of the main tray 71. In such a case, the sheet medium or media 12*a* are bent, buckled or damaged, and the sheet medium or media 12*a* cannot smoothly set in the sheet-medium feed tray 70 by the user.

In order to avoid such a situation, in the first embodiment, the height of the shaft receiving parts 104 is set so that, when the main tray 71 is located at the depression position, the rear end part of the upper surface of the main tray 71 is at the same height as the front end part of the upper surface of the auxiliary stacker plate 76, or becomes lightly lower than the front end part of the upper surface of the auxiliary stacker plate 76.

Accordingly, the auxiliary stacker plate 76 is provided so that its front end part (located closer to the casing CS) is higher and the rear end part (located farther from the casing CS) is lower between the main tray 71 and the first auxiliary tray 72. Since the auxiliary stacker plate 76 covers the boundary portion such as a step portion or a gap portion between the main tray 71 and the first auxiliary tray 72, the front end of the sheet medium or media 12*a* stacked on the main tray 71 can be avoided from abutting against the lateral surface of the rear end part of the main tray 71. As a result, the sheet medium or media 12*a* can be prevented from being bent, buckled or damaged, and therefore the sheet medium or media 12*a* can be smoothly set in the sheet-medium feed tray 70 by the user.

A recess 71*c* having a predetermined length in the width direction A2 is formed at a middle part of the rear end part of the main tray 71. A projected piece 76*k* having a predetermined length in the width direction A2 is provided nearly in the middle part of the front end part of the auxiliary stacker plate 76 at a position corresponding to the recess 71*c* of the main tray 71 so that the projected piece 76*k* is received by the recess 71*c*.

In order that the first auxiliary tray 72 can be avoided from being slightly moved in the width direction A2 of the sheet-medium feed tray 70 or from being tiled to the main tray 71 when the first auxiliary tray 72 is drawn out from the main tray 71, projections 76*e* as first arc-shaped engaging parts are provided at predetermined positions of the auxiliary stacker plate 76. In the first embodiment, the projections 76*e* projected toward the first auxiliary tray 72 and extended in the conveyance direction of the sheet medium 12*a* are provided on the rear surface of the auxiliary stacker plate 76 in the vicinity of one end of the sheet-medium feed tray 70 in the width direction A2 in order to guide the first auxiliary tray 72 and to position it relative to the main tray 71 in the width direction A2 of the sheet-medium feed tray 70. Grooves 72*e* as second engaging parts are provided in the first auxiliary tray 72 at positions corresponding to the projections 76*e* to receive the projections 76*e*. Although the projections 76*e* and the grooves 72*e* are provided at on end side of the sheet-medium feed tray 70 in the width direction A2 in the first embodiment, the projections 76*e* and the grooves 72*e* may be provided at both ends of the sheet-medium feed tray 70 in the width direction A2.

In order that the auxiliary stacker plate 76 can be swung smoothly when the first auxiliary tray 72 is drawn from the main tray 71 or the first auxiliary tray 72 is inserted into the main tray 71, ribs 76*h* as abutting parts and as reinforcing parts are provided at predetermined positions of the auxiliary stacker plate 76 and, in the first embodiment, at both edges of the rear end part of the auxiliary stacker plate 76. Furthermore, sliding surfaces 72*h* for causing the tips of the ribs 76*h* to slide are provided in the upper surface of the first auxiliary tray 72 at positions corresponding to the ribs 76*h*.

As illustrated in FIG. 4. the sliding surfaces 72*h* include a first surface s1 formed in the vicinity of the front end part of the first auxiliary tray 72, a first tilted surface p1 formed on the rear end part of the first surface s1, a second surface s2 formed adjacent to the first tilted surface p1 and a rear side of the first tilted surface p1, a second tilted surface p2 formed at the rear end part of the second surface s2, and a third surface s3 formed adjacent to the second tilted surface p2 and a rear side of the second tilted surface p2. The second surface s2 is formed to be slightly higher than the first surface s1, and the third surface s3 is formed to be slightly higher than the second surface s2.

When the first auxiliary tray 72 is drawn from or inserted into the main tray 71, the sliding surfaces 72*h* of the first auxiliary tray 72 function as cam surfaces, and the ribs 76*h* function as cam followers. As the first auxiliary tray 72 is moved (drawn or inserted), the tips of the ribs 76*h* successively abut against first to third surfaces s1 to s3 along the sliding surfaces 72*h* of the first auxiliary tray 72 to rotate the auxiliary stacker plate 76 and to change a tile angle of the auxiliary stacker plate 76 relative to the first auxiliary tray 72. The tilt angle of the auxiliary stacker plate 76 becomes the largest when the first auxiliary tray 72 is fully drawn from the main tray 71 and the tips of the ribs 76*h* abut against the first surface s1. As the first auxiliary tray 72 is inserted into the main tray 71, the tilt angle of the auxiliary stacker plate 76 becomes small and, when the first auxiliary tray 72 is fully inserted in the main tray 71 and the tips of the ribs 76*h* abut against the third surface s3, the tilt angle becomes approximately zero, that is, the auxiliary stacker plate 76 becomes approximately parallel to the upper surface of the main tray 71.

Slits 76*g* as recesses are formed in the rear end parts of the auxiliary stacker plate 76 at a plurality of locations in the width direction A2 (at seven locations, for example). Ribs 72*g* as first projections and as reinforcing parts are provided at locations in the front end part of the first auxiliary tray 72 corresponding to the slits 76*g* so that the ribs 72*g* and the slits 76*g* are parallel to each other and the ribs 72*g* have a predetermined length in the conveyance direction of the sheet medium 12*a*.

A rib 72*k* as a second projection and as a reinforcing part is provided at rear end parts of the ribs 72*g* so as to extend along the width direction A2 of the sheet-medium feed tray 70. Recesses 72*i* as depressions are provided between the adjacent ribs 72*g* respectively.

The indication marks 76*f* of printed letters indicative of stack locations of different sizes of the sheet medium 12*a* on the sheet-medium feed tray 70 is provided in the vicinity of the rear end part of the auxiliary stacker plate 76.

The auxiliary stacker plate 76 and the first auxiliary tray 72 are contacted with only the ribs 76*h* and the sliding surfaces 72*h* in the first embodiment. Thus, when the first auxiliary tray 72 is drawn from the main tray 71 or the first auxiliary tray 72 is inserted into the first auxiliary tray 72, parts 76*i* (referred to as a diagonally downward parts) of the auxiliary stacker plate 76 other than the slits 76*g* in the rear end part of the auxiliary stacker plate 76 are not contacted with the upper surface of the first auxiliary tray 72, so that a slight gap is formed between the diagonally downward parts 76*i* and the upper surface of the first auxiliary tray 72. Accordingly, since a frictional resistance between the auxiliary stacker plate 76 and the first auxiliary tray 72 can be made small, the first auxiliary tray 72 can be easily drawn from the main tray 71 or the first auxiliary tray 72 can be easily and smoothly inserted into the main tray 71.

Explanation will next be made as to operation of the sheet-medium feed mechanism 90 when the sheet-medium feed tray 70 having the aforementioned structure is closed. First of all, explanation will be made as to a first state of the sheet-medium feed mechanism 90 when the first auxiliary tray 72 is fully drawn from the main tray 71.

Figure 6:
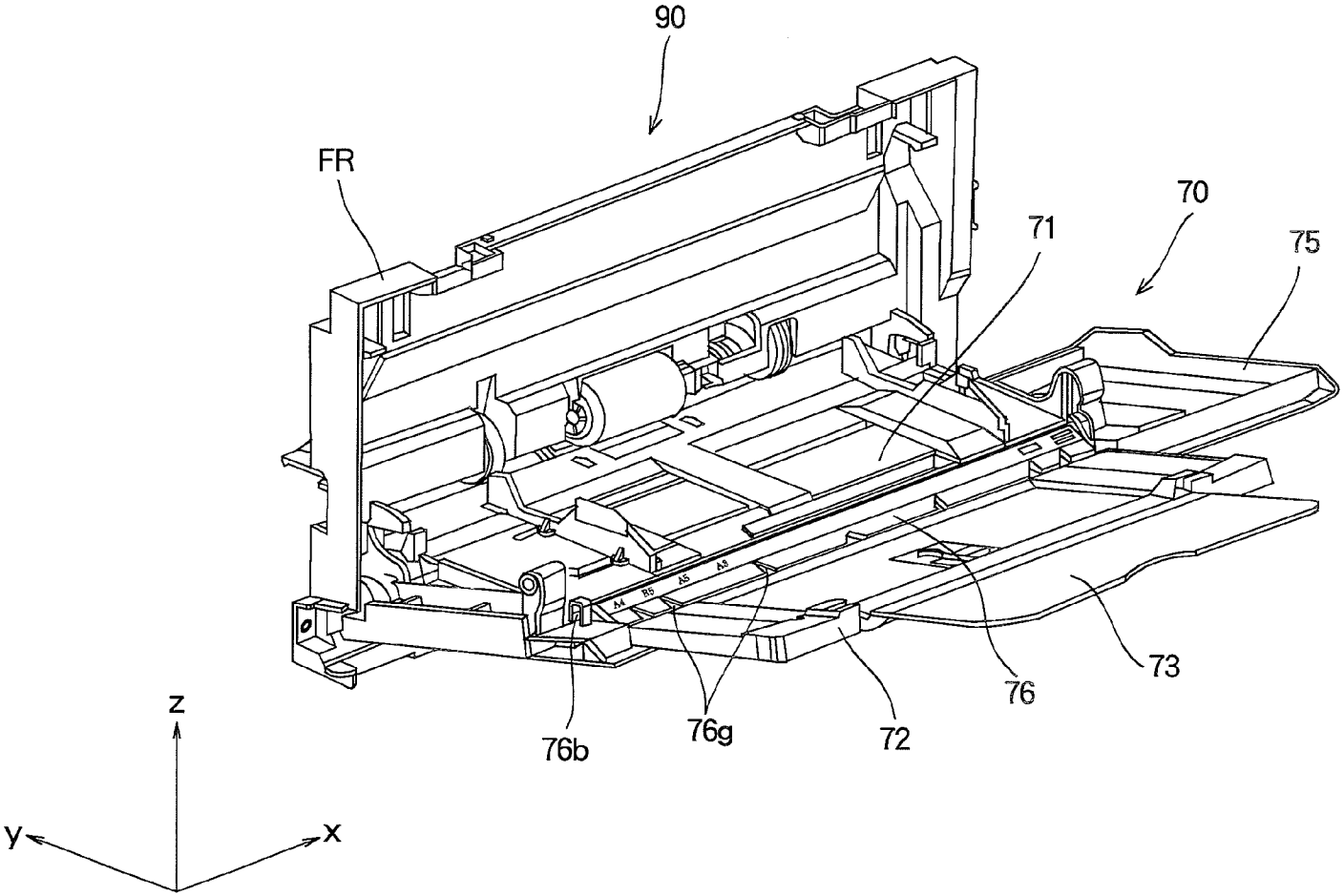
FIG. 6 is a perspective view schematically showing a first state of the second sheet-medium feed mechanism in the first embodiment.
Figure 7:
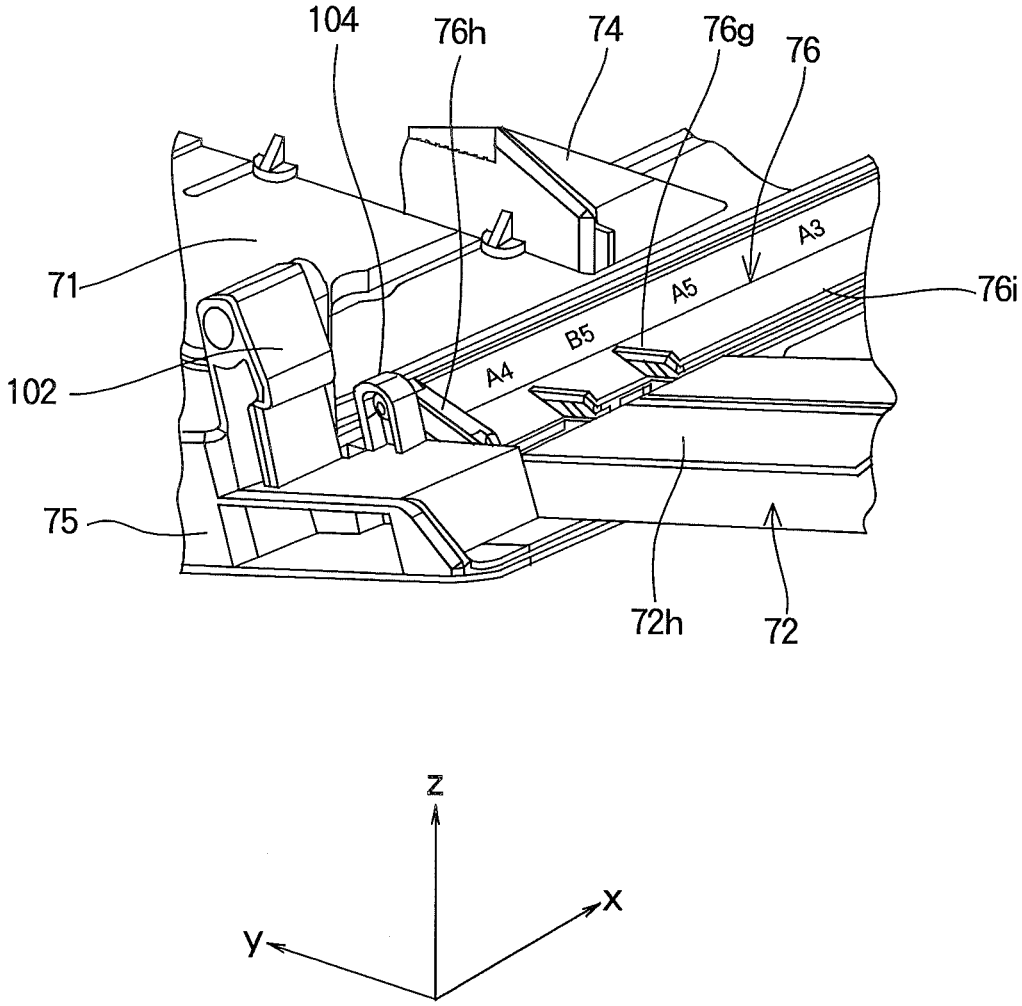
FIG. 7 is a perspective view schematically showing a major part of the second sheet-medium feed mechanism in the first state in the first embodiment.
Figure 8:
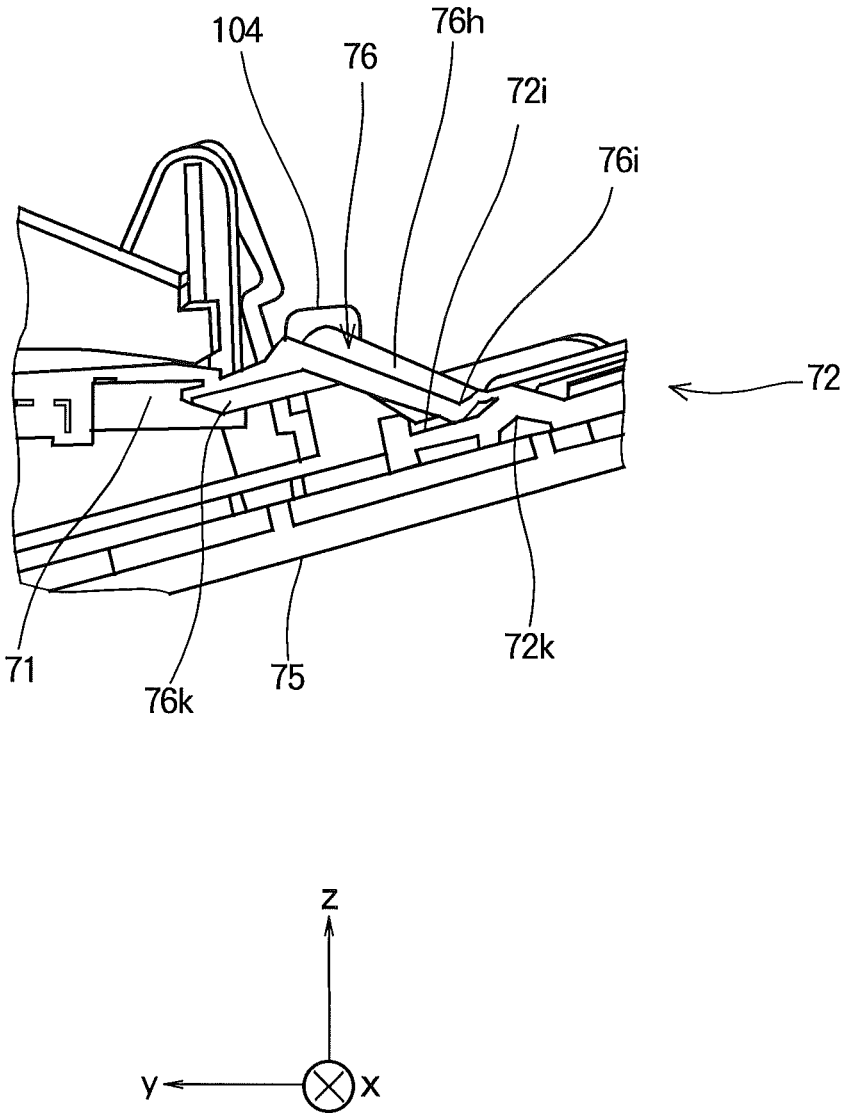
FIG. 8 is a cross-sectional view schematically showing a first major part of the second sheet-medium feed mechanism in the first state in the first embodiment.
Figure 9:
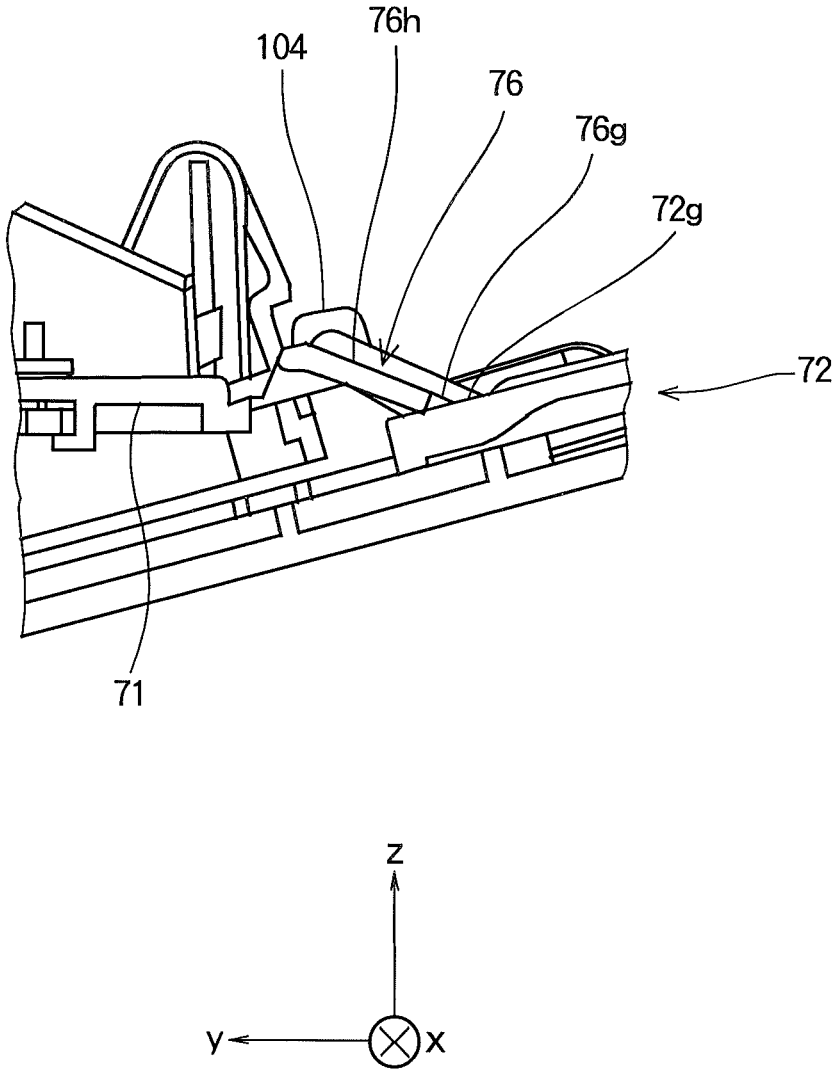
FIG. 9 is a cross-sectional view schematically showing a second major part of the second sheet-medium feed mechanism in the first state in the first embodiment.

FIG. 6 is a perspective view schematically showing the first state of the sheet-medium feed mechanism 90 in the first embodiment, and FIG. 7 is a perspective view schematically showing a major part of the sheet-medium feed mechanism 90 in the first state. FIG. 8 is a cross-sectional view schematically showing a first major part of the sheet-medium feed mechanism 90 in the first state (i.e., a cross-sectional view taken along a line not including the slit 76*g*), and FIG. 9 is a cross-sectional view schematically showing a second major part of the sheet-medium feed mechanism 90 in the first state (i.e., a cross-sectional view taken along a line including the slit 76*g*).

In the first state of the second sheet-medium feed mechanism 90, the sheet-medium feed tray 70 is rotated and opened from the frame FR of the casing CS, the first auxiliary tray 72 is fully drawn from the main tray 71, and the second auxiliary tray 73 is expanded relative to the first auxiliary tray 72. FIGS. 6 to 8 show the first state in which the main tray 71 is located at the sheet-medium feed position. FIGS. 6 to 8 show a case where no sheet media 12*a* are stacked on the main tray 71.

The tips of the ribs 76*h* are contacted with the first surface s1 (refer to FIG. 4). At this time, the ribs 72*g* are slightly advanced into the slits 76*g*, and the diagonally downward parts 76*i* are advanced into the associated recesses 72*i* formed between the ribs 72*g*.

At this time, top walls of the ribs 72*g* become higher than the lowest ends of the diagonally downward parts 76*i*. Thus, even when the main tray 71 is located at the depression position and the sheet medium or media 12*a* are set in the sheet-medium feed tray 70 by the user, the front end of the sheet medium or media 12*a* can be prevented from being located at a position lower than the top walls of the ribs 72*g* and from being located at a position lower than the lowest ends of the diagonally downward parts 76*i*. Accordingly, the front end of the sheet medium or media 12*a* can be avoided from abutting against the lowest ends of the diagonally downward parts 76*i*.

As mentioned above, the rear end part of the upper surface of the main tray 71 is located at the same height as the front end part of the upper surface of the auxiliary stacker plate 76 or at a position slightly lower than the front end part of the upper surface of the auxiliary stacker plate 76. Therefore, the front end of the sheet medium or media 12*a* can be prevented from abutting against the lateral surface of the rear end part of the main tray 71.

In this way, since the boundary part (the gap portion or the step portion) between the main tray 71 and the first auxiliary tray 72 is covered with the auxiliary stacker plate 76, the front end of the sheet medium or media 12*a* stacked on the main tray 71 can be prevented from abutting against the lateral surface of the rear end part of the main tray 71. As a result, the sheet medium or media 12*a* can be avoided from being bent, buckled or damaged, so that the sheet medium or media 12*a* can be smoothly set in the sheet-medium feed tray 70 by the user.

In the drawings, reference numeral 74 denotes a side surface guide member, numerals 102 and 104 denote shaft receiving parts, 76*k* denotes a projected piece, and 72*k* denotes a rib. Since the main tray 71 is located at the sheet-medium feed position, the projected piece 76*k* is tilted to be directed slightly downward relative to the main tray 71 as shown in FIG. 8.

Figure 10:
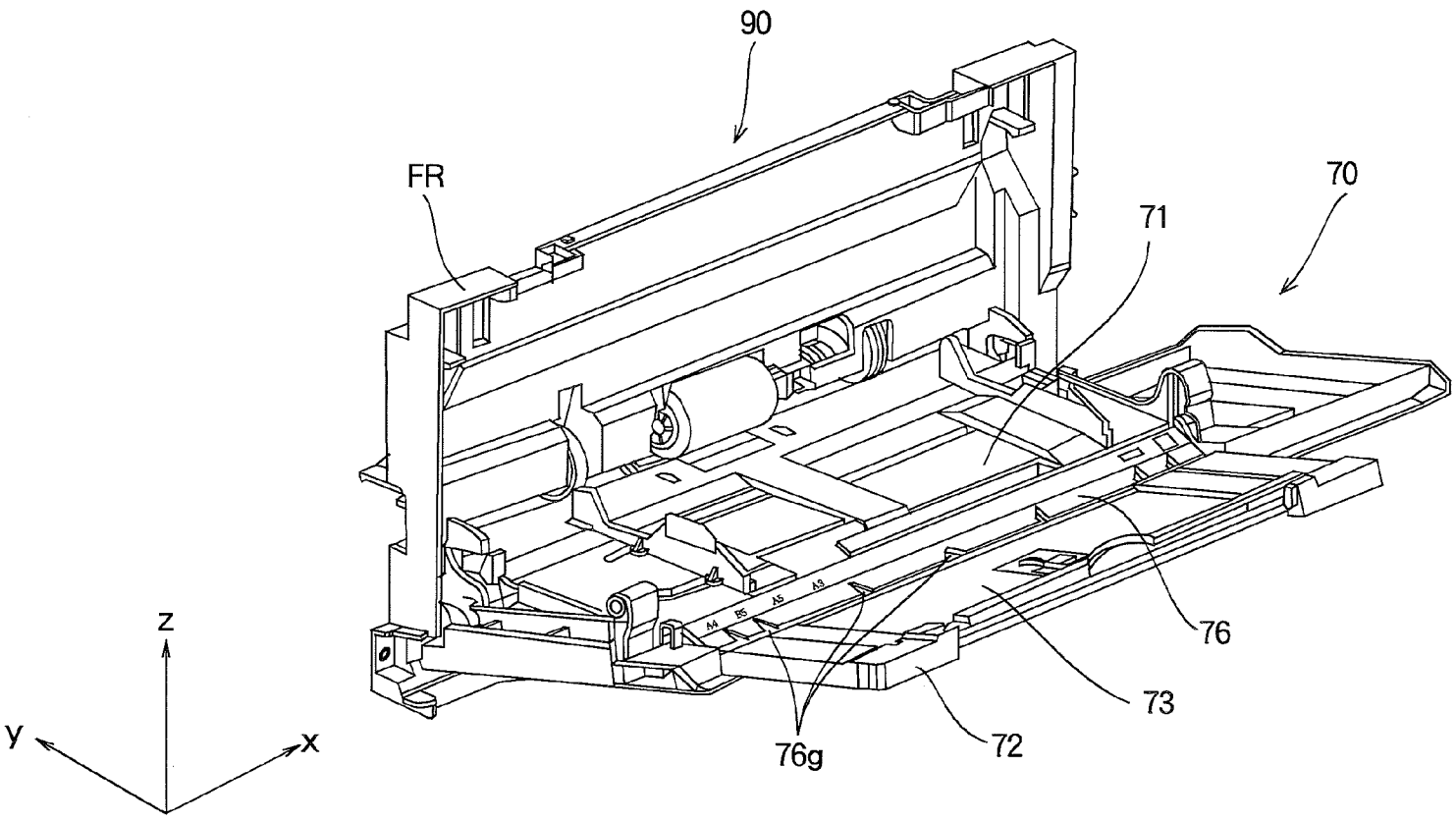
FIG. 10 is a perspective view schematically showing a second state of the second sheet-medium feed mechanism in the first embodiment.
Figure 11:
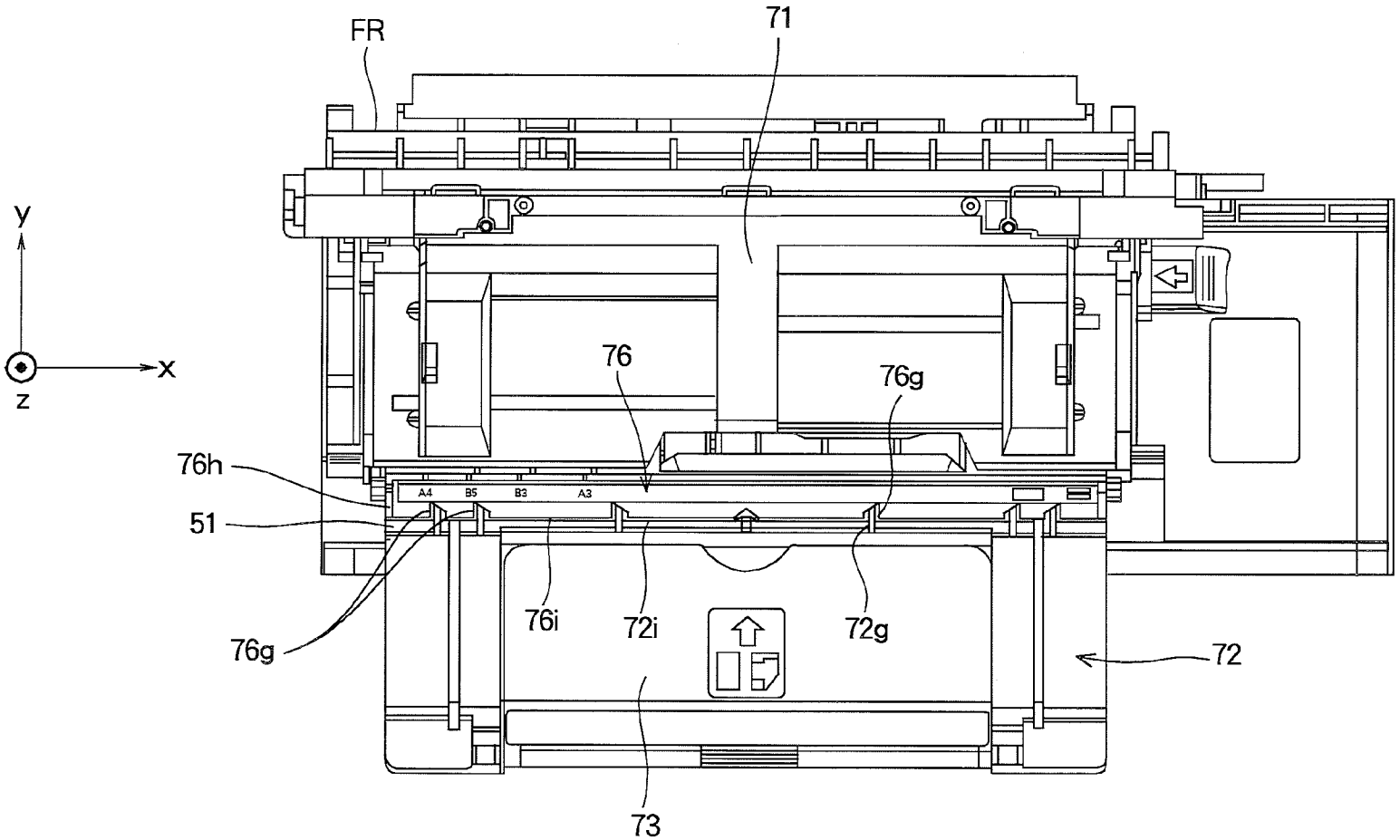
FIG. 11 is a plan view schematically showing a major part of the second sheet-medium feed mechanism in the second state in the first embodiment.

Explanation will next be made as to a second state of the second sheet-medium feed mechanism 90 indicative of a folded state of the second auxiliary tray 73. FIG. 10 is a perspective view schematically showing the second state of the second sheet-medium feed mechanism 90 in the first embodiment, and FIG. 11 is a plan view schematically showing a major part of the second sheet-medium feed mechanism 90 in the second state.

In the second state of the second sheet-medium feed mechanism 90, the sheet-medium feed tray 70 is rotated and opened from the frame FR of the casing CS, the first auxiliary tray 72 is fully drawn from the main tray 71, and the second auxiliary tray 73 is folded over the first auxiliary tray 72. No sheet media 12*a* are stacked on the main tray 71 and the main tray 71 is located at the sheet-medium feed position. With respect to the auxiliary stacker plate 76, similarly to the first state of the second sheet-medium feed mechanism 90, the tips of the ribs 76*h* are contacted with the first surface s1. At this time, the ribs 72*g* are advanced slightly into the slits 76*g*, and the diagonally downward parts 76*i* are advanced into the recesses 72*i*.

Figure 12:
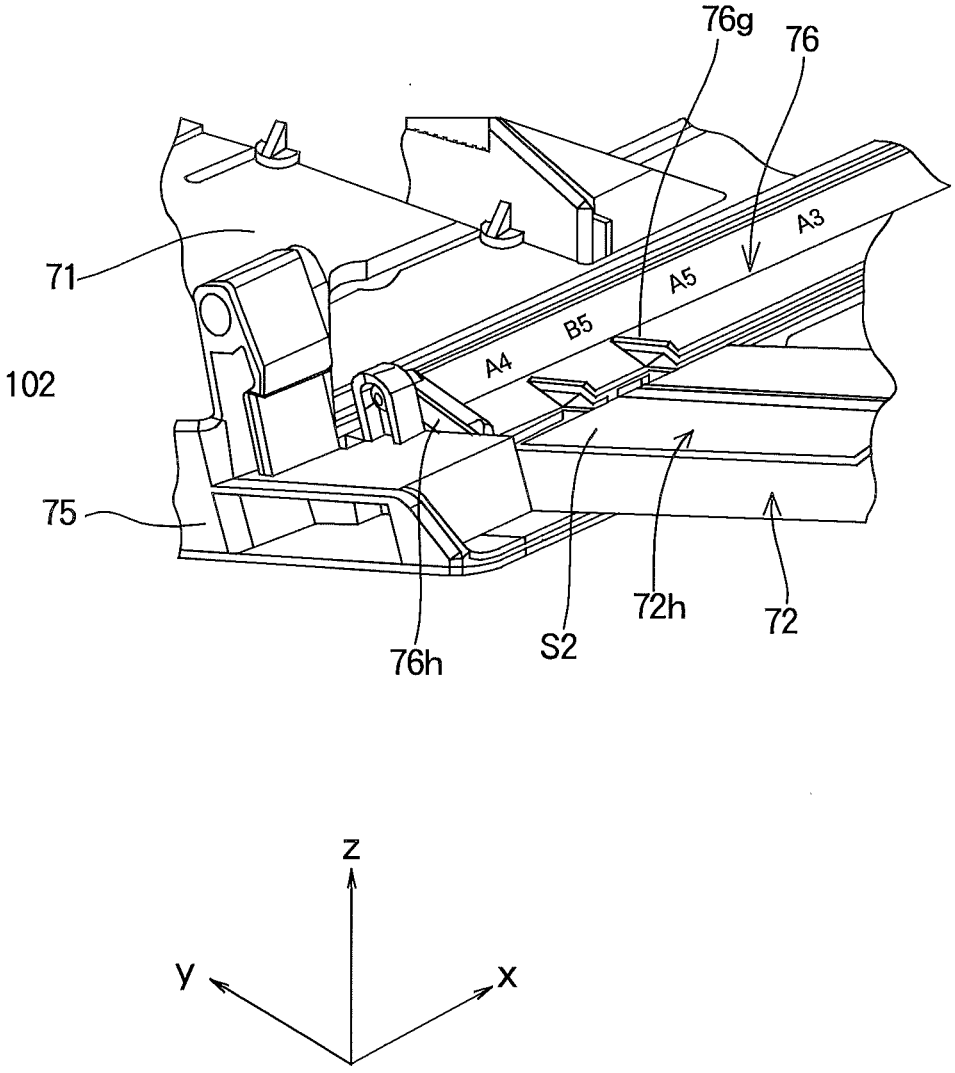
FIG. 12 is a perspective view schematically showing a major part of the second sheet-medium feed mechanism in a third state in the first embodiment.
Figure 13:
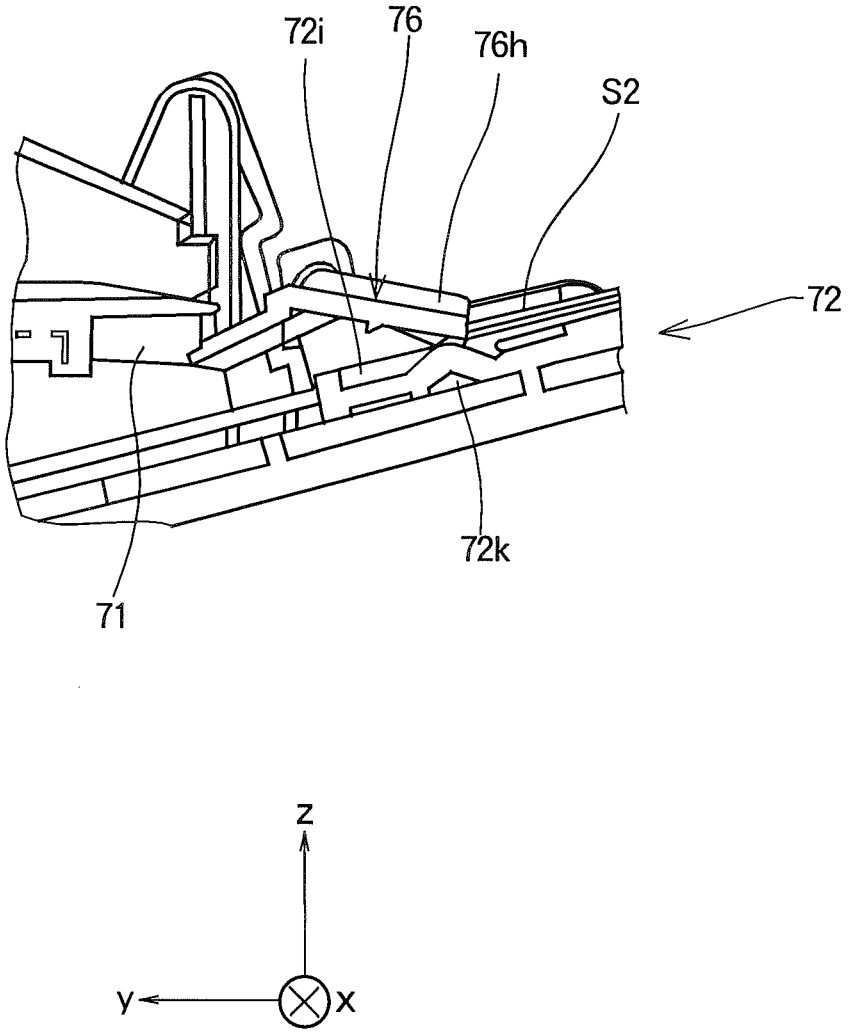
FIG. 13 is a first cross-sectional view schematically showing a major part of the second sheet-medium feed mechanism in the third state in the first embodiment.
Figure 14:
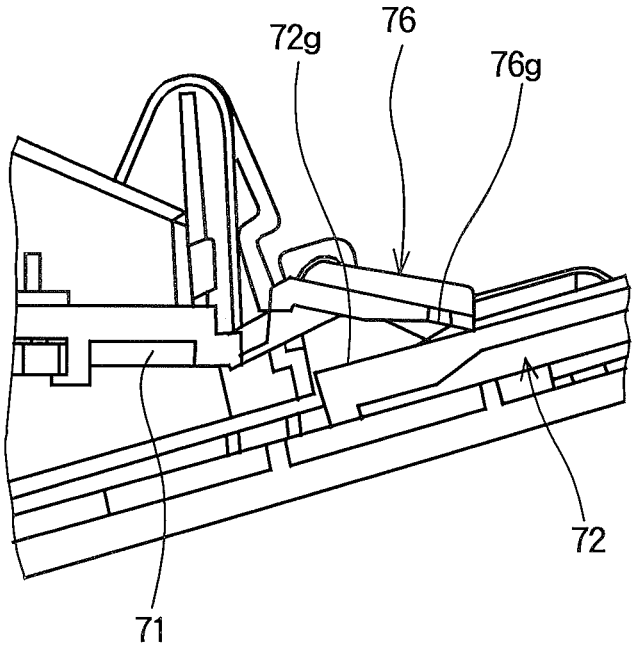
FIG. 14 is a second cross-sectional view schematically showing a major part of the second sheet-medium feed mechanism in the third state in the first embodiment.
Figure 14:
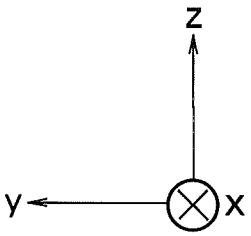

Explanation will next be made as to as to a third state of the second sheet-medium feed mechanism 90 wherein the first auxiliary tray 72 is slightly inserted in the main tray 71. FIG. 12 is a perspective view schematically showing a major part of the second sheet-medium feed mechanism 90 in the third state in the first embodiment, FIG. 13 is a cross-sectional view schematically showing a major part of the second sheet-medium feed mechanism 90 in the third state in the first embodiment (i.e., a cross-sectional view taken along a line not including the slit 76*g*), and FIG. 14 is a cross-sectional view schematically showing a second major part of the second sheet-medium feed mechanism 90 in the third state in the first embodiment (i.e., a cross-sectional view taken along a line including the slit 76*g*).

In the third state of the second sheet-medium feed mechanism 90, the sheet-medium feed tray 70 (FIG. 2) is rotated to be opened from the frame FR of the casing CS, the first auxiliary tray 72 is inserted slightly in the main tray 71, and the second auxiliary tray 73 is folded over the first auxiliary tray 72. No sheet media 12*a* are stacked on the main tray 71 and the main tray 71 is located at the sheet-medium feed position.

In this case, when the first auxiliary tray 72 is inserted into the main tray 71, the auxiliary stacker plate 76 linked with the first auxiliary tray 72 is moved together with the first auxiliary tray 72. In the first embodiment, when the first auxiliary tray 72 is inserted into the main tray 71, the auxiliary stacker plate 76 linked with the first auxiliary tray 72 is rotated, the tips of the ribs 76*h* abut against the second surface s2, and the tilt angle of the auxiliary stacker plate 76 becomes small. At this time, the ribs 72*g* are released from the slits 76*g*. The diagonally downward parts 76*i* are also released from the recesses 72*i* so that the lowest ends of the diagonally downward parts 76*i* are located at a position slightly higher than the top walls of the ribs 72*k*.

In the third state of the second sheet-medium feed mechanism 90, even when the auxiliary stacker plate 76 is rotated, the rear end part of the main tray 71 is avoided from being located at a position higher than the front end part of the auxiliary stacker plate 76.

Figure 15:
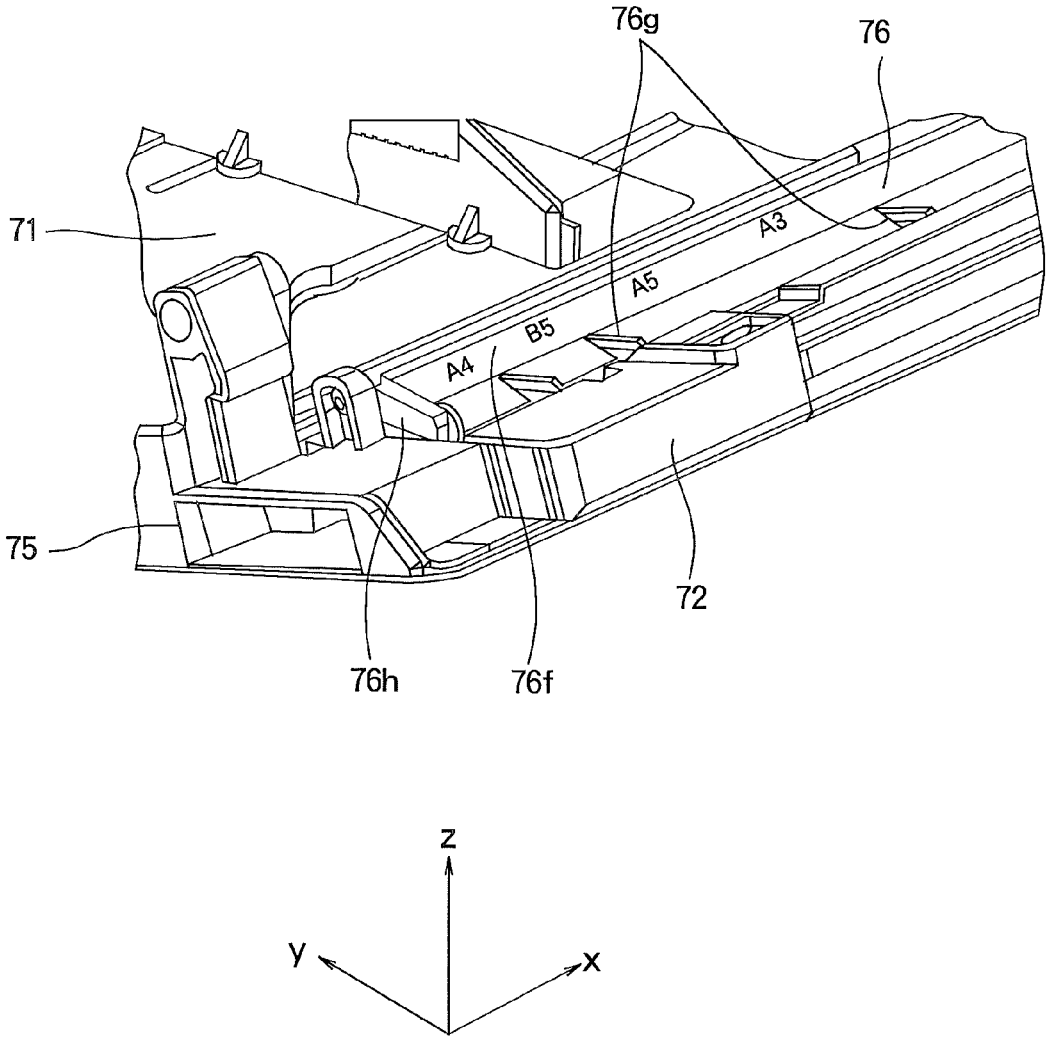
FIG. 15 is a perspective view schematically showing a major part of the second sheet-medium feed mechanism in a fourth state in the first embodiment.
Figure 16:
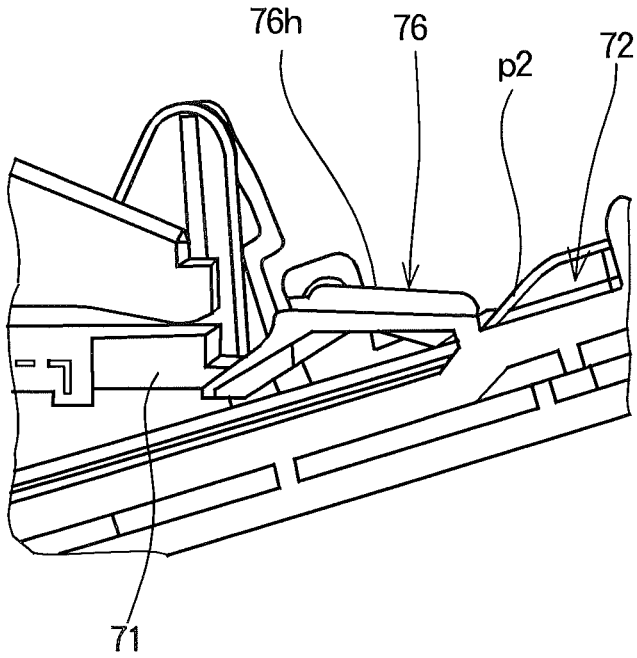
FIG. 16 is a first cross-sectional view schematically showing a major part of the second sheet-medium feed mechanism in the fourth state in the first embodiment.
Figure 16:
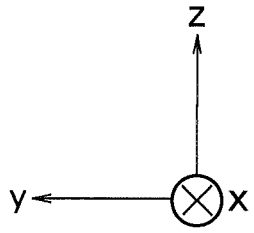
Figure 17:
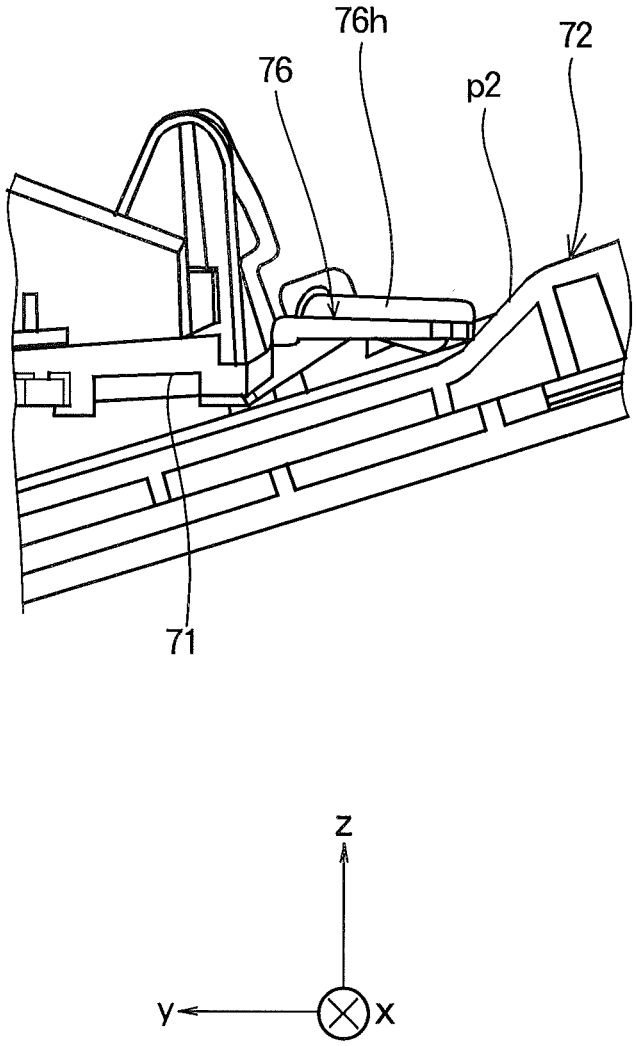
FIG. 17 is a second cross-sectional view schematically showing a major part of the second sheet-medium feed mechanism in the fourth state in the first embodiment.

Explanation will next be made as to a fourth state of the second sheet-medium feed mechanism 90 when the first auxiliary tray 72 is further inserted in the main tray 71. FIG. 15 is a perspective view schematically showing a major part of the second sheet-medium feed mechanism 90 in the fourth state in the first embodiment, FIG. 16 is a cross-sectional view schematically showing a first major part of the second sheet-medium feed mechanism 90 in the fourth state in the first embodiment (i.e., a cross-sectional view taken along a line not including the slit 76*g*), and FIG. 17 is a cross-sectional view schematically showing a second major part of the second sheet-medium feed mechanism 90 in the fourth state in the first embodiment (i.e., a cross-sectional view taken along a line including the slit 76*g*).

In the fourth state of the second sheet-medium feed mechanism 90, the sheet-medium feed tray 70 is rotated and opened from the frame FR of the casing CS, the first auxiliary tray 72 is further inserted into the main tray 71, and the second auxiliary tray 73 is folded over the first auxiliary tray 72. No sheet media 12*a* are stacked on the main tray 71 and the main tray 71 is located at the sheet-medium feed position.

In this case, the first auxiliary tray 72 is further inserted into the main tray 71, the auxiliary stacker plate 76 linked with the first auxiliary tray 72 is further rotated together with the first auxiliary tray 72, the tips of the ribs 76*h* are contacted with the second tilted surface p2, the tilt angle of the auxiliary stacker plate 76 becomes smaller, and the indication marks 76*f* are directed approximately upward.

In the fourth state of the second sheet-medium feed mechanism 90, even when the auxiliary stacker plate 76 is rotated, the rear end part of the main tray 71 can be avoided from being located to be higher than the front end part of the auxiliary stacker plate 76.

Figure 18:
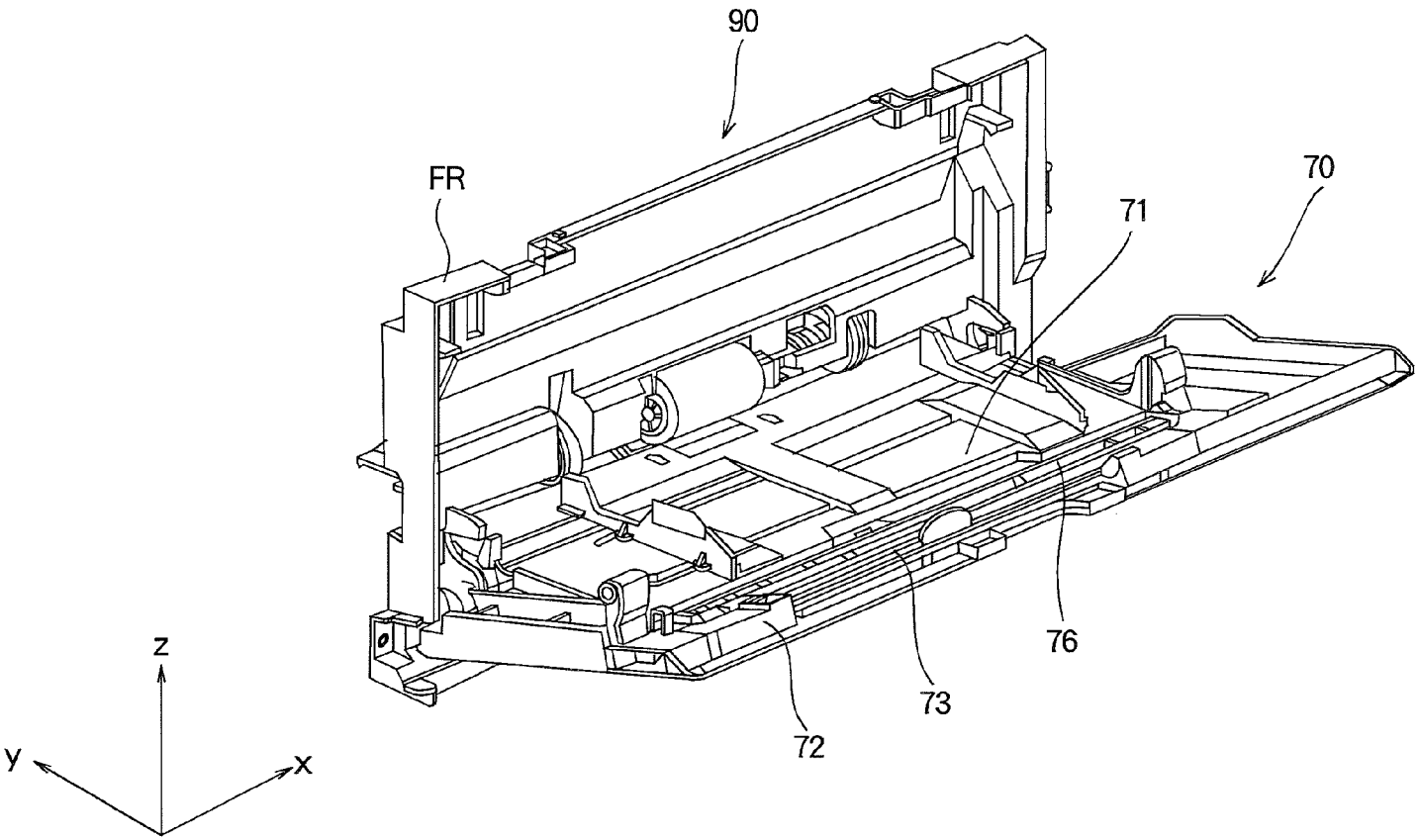
FIG. 18 is a perspective view schematically showing a fifth state of the second sheet-medium feed mechanism in the first embodiment.
Figure 19:
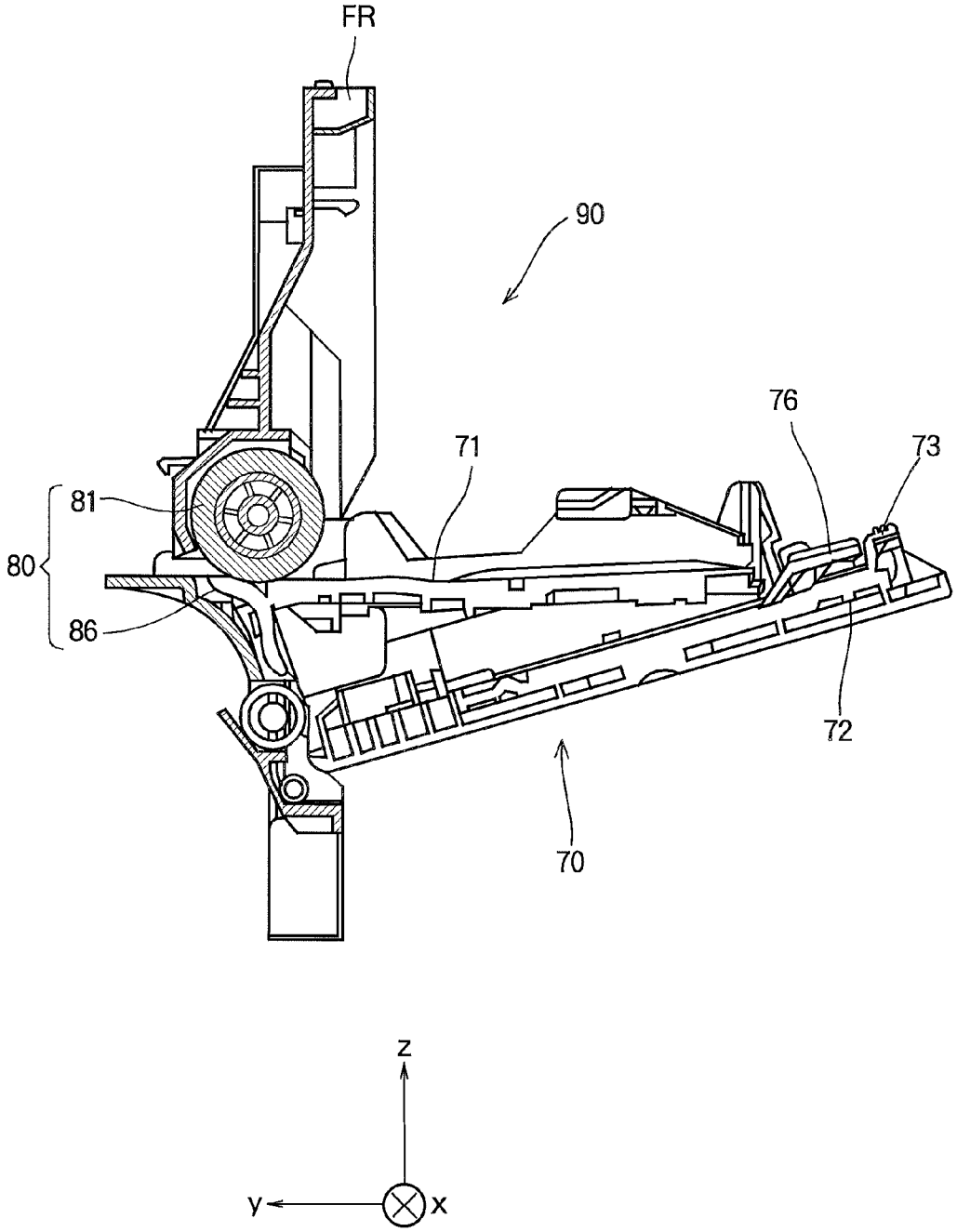
FIG. 19 is a cross-sectional view schematically showing the fifth state of the second sheet-medium feed mechanism in the first embodiment.
Figure 20:
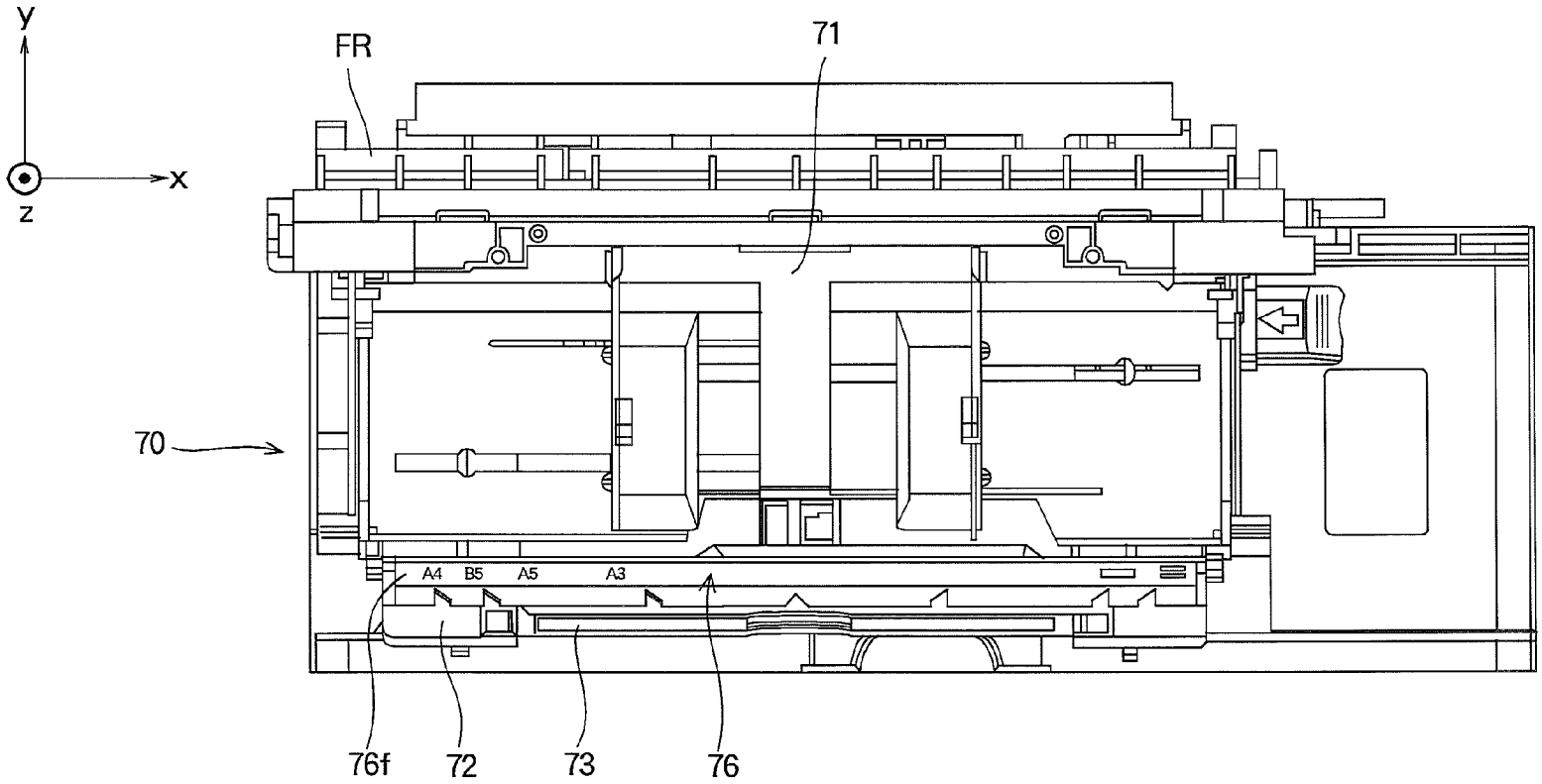
FIG. 20 is a plan view schematically showing the fifth state of the second sheet-medium feed mechanism in the first embodiment.
Figure 21:
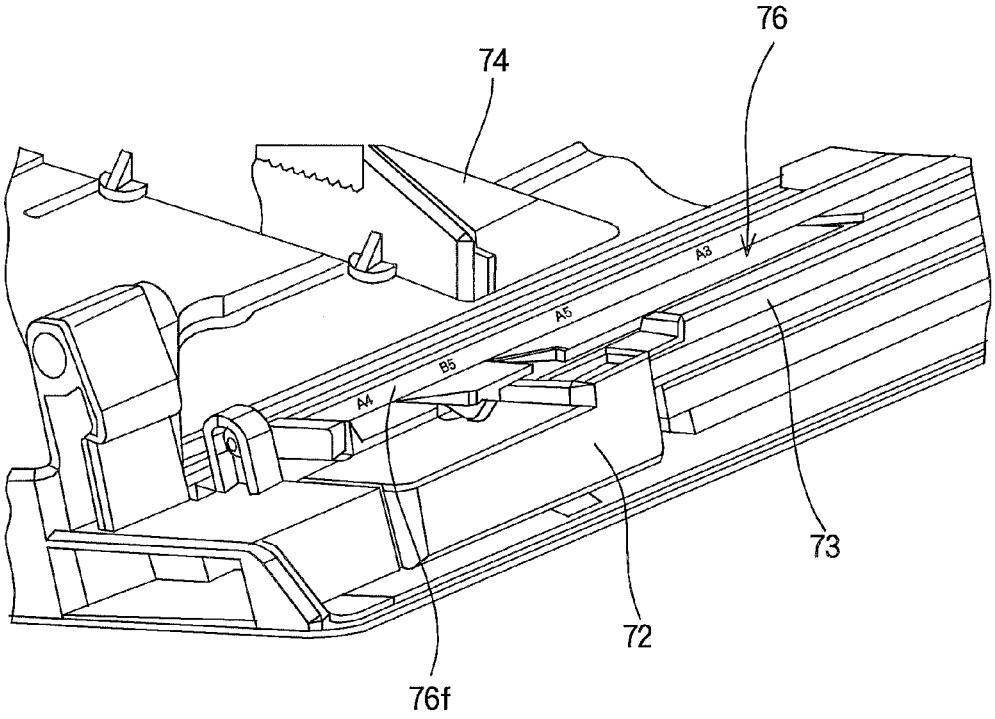
FIG. 21 is a perspective view schematically showing a major part of the second sheet-medium feed mechanism in the fifth state in the first embodiment.
Figure 21:
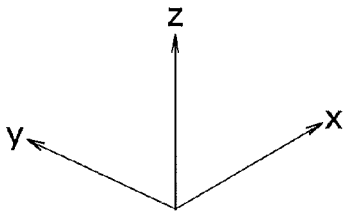
Figure 22:
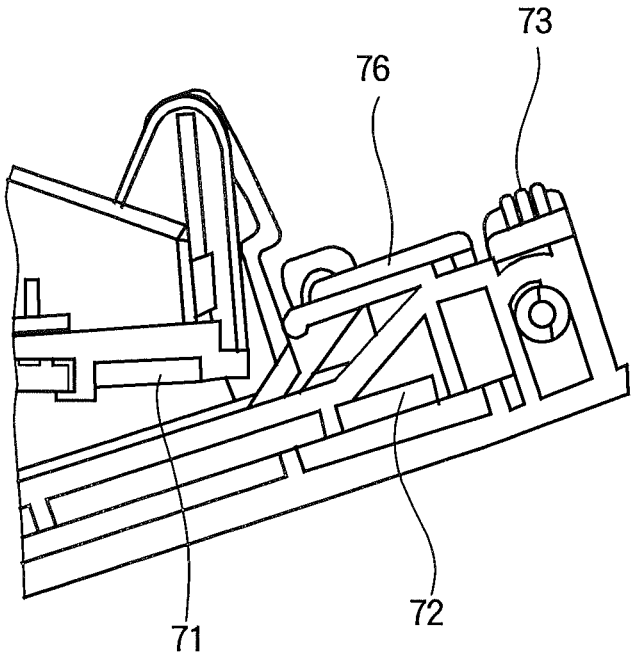
FIG. 22 is a first cross-sectional view schematically showing a major part of the second sheet-medium feed mechanism in the fifth state in the first embodiment.
Figure 22:
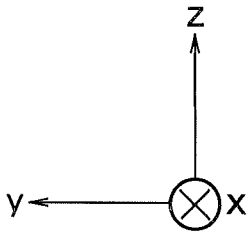
Figure 23:
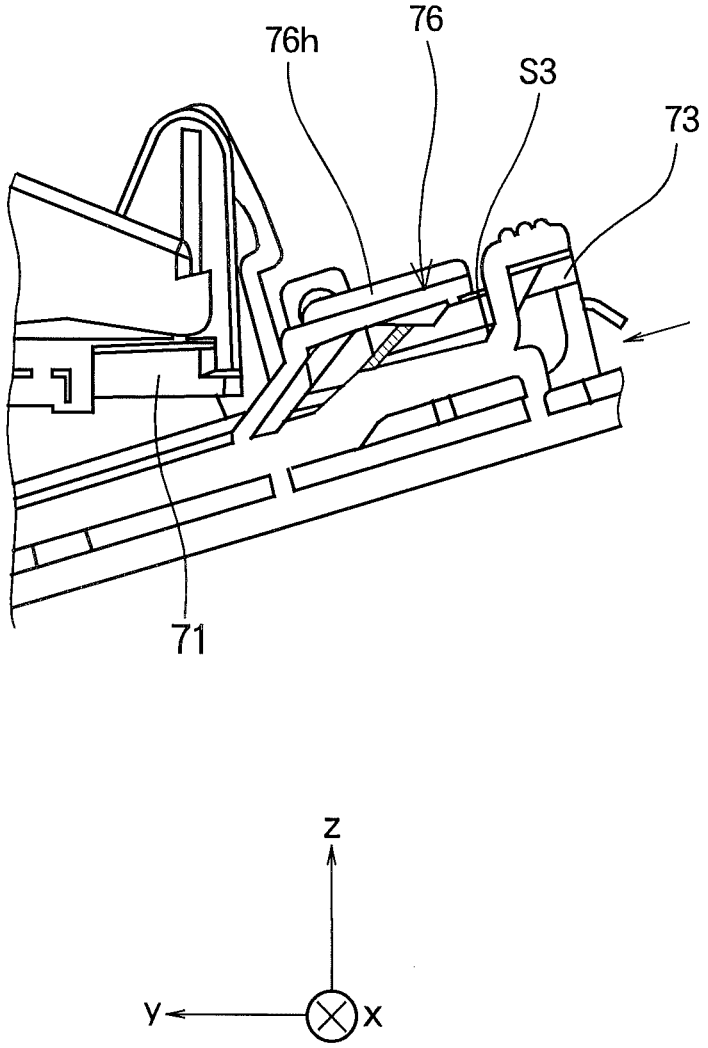
FIG. 23 is a second cross-sectional view schematically showing a major part of the second sheet-medium feed mechanism in the fifth state in the first embodiment.

Explanation will next be made as to a fifth state of the second sheet-medium feed mechanism 90 when the first auxiliary tray 72 is fully inserted in the main tray 71. FIG. 18 is a perspective view schematically showing the fifth sate of the second sheet-medium feed mechanism 90 in the first embodiment, FIG. 19 is a cross-sectional view schematically showing the fifth state of the second sheet-medium feed mechanism 90 in the first embodiment, and FIG. 20 is a plan view schematically showing the fifth state of the second sheet-medium feed mechanism 90 in the first embodiment. FIG. 21 is a perspective view schematically showing a major part of the second sheet-medium feed mechanism 90 in the fifth state in the first embodiment, FIG. 22 is a cross-sectional view schematically showing a first major part of the second sheet-medium feed mechanism 90 in the fifth sate in the first embodiment (i.e., a cross-sectional view taken along a line not including the slit 76*g*), and FIG. 23 is a cross-sectional view schematically showing a second major part of the second sheet-medium feed mechanism 90 in the fifth sate in the first embodiment (i.e., a cross-sectional view taken along a line including the slit 76*g*).

In the fifth state of the second sheet-medium feed mechanism 90, the sheet-medium feed tray 70 is rotated and opened from the frame FR of the casing CS, the first auxiliary tray 72 is fully inserted in the main tray 71, and the second auxiliary tray 73 is folded over the first auxiliary tray 72. No sheet media 12*a* are stacked on the main tray 71 and the main tray 71 is located at the sheet-medium feed position. In FIG. 19, reference numeral 80 denotes a sheet-medium pick-up feeder, 81 denotes a pickup roller, and 86 denotes a separating piece.

In this case, when the first auxiliary tray 72 is fully inserted in the main tray 71, the auxiliary stacker plate 76 linked with the first auxiliary tray 72 is further rotated together with the first auxiliary tray 72, so that the tips of the ribs 76*h* abut against the third surface s3, the auxiliary stacker plate 76 is made to be parallel to the upper surface of the first auxiliary tray 72, and the indication marks 76*f* are directed more upward.

In the fifth state of the second sheet-medium feed mechanism 90, even when the auxiliary stacker plate 76 is rotated, the rear end part of the main tray 71 is avoided from becoming higher than the front end part of the auxiliary stacker plate 76.

Explanation will next be made as to a sixth state of the second sheet-medium feed mechanism 90 when the sheet-medium feed tray 70 is closed. FIG. 24 is a perspective view schematically showing the sixth state of the second sheet-medium feed mechanism 90 in the first embodiment, and FIG. 25 is a cross-sectional view schematically showing the sixth state of the second sheet-medium feed mechanism 90 in the first embodiment.

In the sixth state of the second sheet-medium feed mechanism 90, the second auxiliary tray 73 is folded over the first auxiliary tray 72, the first auxiliary tray 72 is fully inserted in the main tray 71, and the sheet-medium feed tray 70 is closed to the frame FR of the casing CS. The auxiliary stacker plate 76 is made to be parallel to the upper surface of the first auxiliary tray 72. In FIG. 25, reference numeral 80 denotes a sheet-medium pick-up feeder, 81 denotes a pickup roller, and 86 denotes a separating piece.

When the user opens the sheet-medium feed tray 70 having the aforementioned structure from the casing CS, the second sheet-medium feed mechanism 90 is operated by the user from the sixth to the first states in these order, which is inverse order of the user operation when the user closes the sheet-medium feed tray 70 to the casing CS.

In the first embodiment, in this way, the auxiliary stacker plate 76 is located between the main tray 71 and the first auxiliary tray 72 and the boundary part (the gap portion or the step portion) between the main tray 71 and the first auxiliary tray 72 is covered with the auxiliary stacker plate 76, so that the sheet medium or media 12*a* can be prevented from being bent, buckled or damaged and thus the sheet medium or media 12*a* can be smoothly set in the sheet-medium feed tray 70 by the user.

The auxiliary stacker plate 76 linked with the first auxiliary tray 72 is provided in a swingable manner and is swung or rotated together with the movement of the first auxiliary tray 72. Thus, even when the first auxiliary tray 72 is fully drawn from the main tray 71 or fully inserted in the main tray 71, the boundary part (the gap portion or the step portion) is covered with the auxiliary stacker plate 76. In addition, during the rotating movement of the auxiliary stacker plate 76, the rear end part of the upper surface of the main tray 71 can be avoided from becoming higher than the front end part of the upper surface of the auxiliary stacker plate 76.

Therefore, the sheet medium or media 12*a* can be further prevented from being bent, buckled or damaged and the sheet medium or media 12*a* can be more smoothly set in the sheet-medium feed tray 70 by the user.

As the first auxiliary tray 72 is inserted into the main tray 71, the tilt angle of the auxiliary stacker plate 76 becomes smaller and the indication marks 76*f* are directed more upward. Accordingly, when the sheet medium or media 12*a* having a longer dimension in the conveyance direction is set in the sheet-medium feed tray 70 by the user, the first auxiliary tray 72 is fully drawn from the main tray 71 and the tilt angle of the auxiliary stacker plate 76 becomes large. Thus, the user can see the indication marks 76*f* in a horizontal direction. When the sheet medium 12*a* such as a postcard having a smaller dimension in the conveyance direction is set in the sheet-medium feed tray 70 by the user, the first auxiliary tray 72 is inserted in the main tray 71 and the tilt angle of the auxiliary stacker plate 76 becomes smaller, so that the user can looks down at the indication marks 76*f* from an upper position. As a result, a handling performance when the sheet medium or media 12*a* are set in the sheet-medium feed tray 70 can be improved.

Since the auxiliary stacker plate 76 linked with the first auxiliary tray 72 is rotated together with the movement of the first auxiliary tray 72, the second sheet-medium feed mechanism 90 can be made compact.

Second Embodiment

In the first embodiment, the main tray 71 is mounted to be rotatable to the exterior cover 75 and to be selectively located either at the depression position or at the sheet-medium feed position. The height of the shaft receiving parts 104 is set so that, when the main tray 71 is located at the depression position, the rear end part of the upper surface of the main tray 71 becomes the same as the front end part of the upper surface of the auxiliary stacker plate 76 or the rear end part of the upper surface of the main tray 71 becomes slightly lower than the front end part of the upper surface of the auxiliary stacker plate 76.

In the first embodiment, however, the main tray 71 and the auxiliary stacker plate 76 are both mounted to be rotatable to the exterior cover 75. Thus, when the main tray 71 is located at the depression position, a gap portion between the rear end part of the upper surface of the main tray 71 and the front end part of the upper surface of the auxiliary stacker plate 76 becomes small. Meanwhile, when the main tray 71 is located at the sheet-medium feed position, the gap portion between the rear end part of the upper surface of the main tray 71 and the front end part of the upper surface of the auxiliary stacker plate 76 becomes larger.

Accordingly, when the sheet medium or media 12*a* are stacked on the main tray 71 with the main tray 71 located at the sheet-medium feed position, if the sheet medium or media 12*a* are not in a horizontal position, the sheet medium or media 12*a* may undesirably cause, in some cases, the front end of the sheet medium or media 12*a* stacked on the main tray 71 to abut against the lateral surface of the rear end part of the main tray 71.

To avoid such a situation, a second embodiment is arranged so that, even the main tray 71 is located either at the depression position or at the sheet-medium feed position, the front end of the sheet medium or media 12*a* stacked on the main tray 71 can be avoided from abutting against the lateral surface of the rear end part of the main tray 71. In the second embodiment, constituent elements having the same or similar structures as or to those in the first embodiment are denoted by the same reference numerals or symbols.

Figure 26:
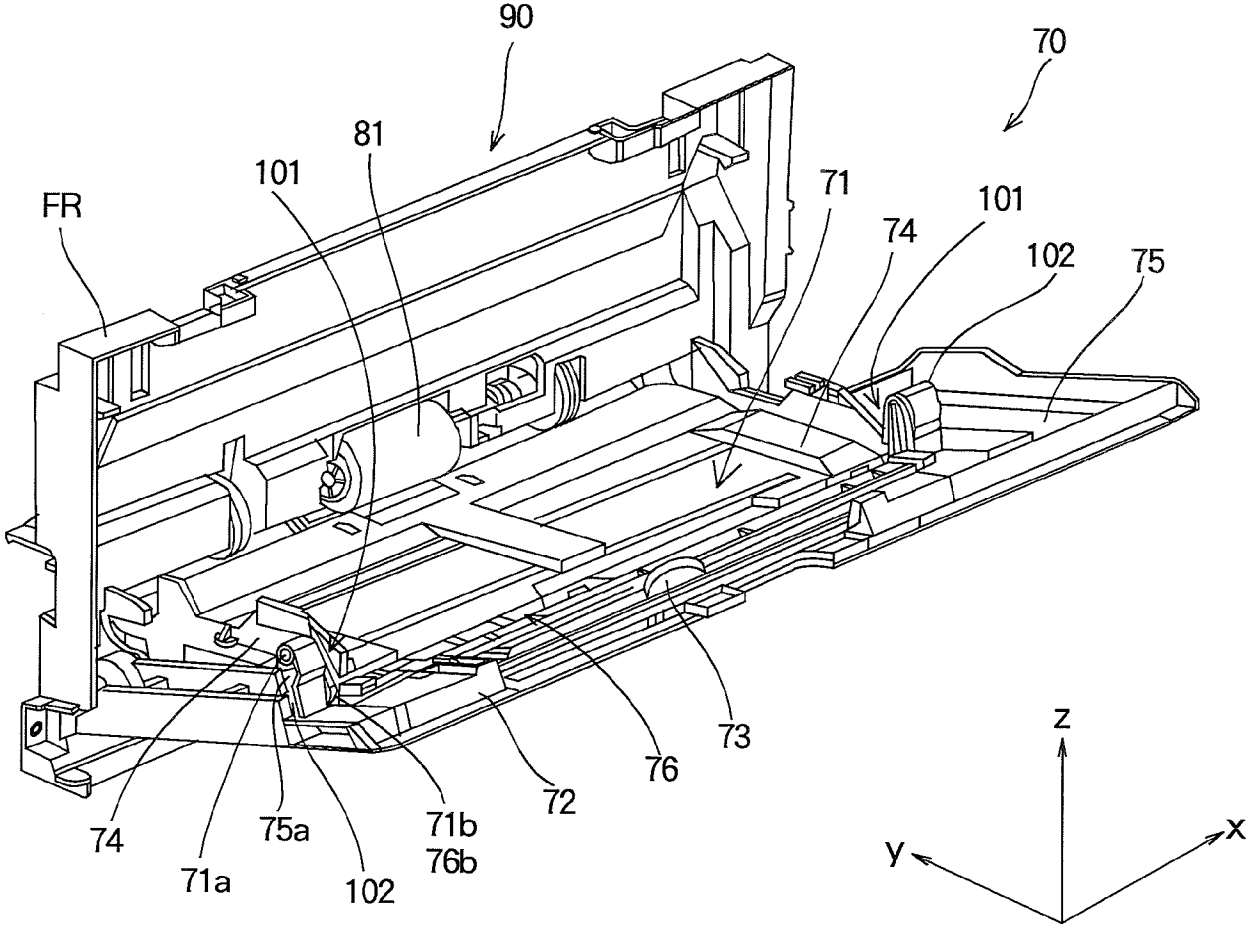
FIG. 26 is a perspective view schematically showing structure of the second sheet-medium feed mechanism when a main tray is located at a sheet-medium feed position in a second embodiment of the present invention.
Figure 27:
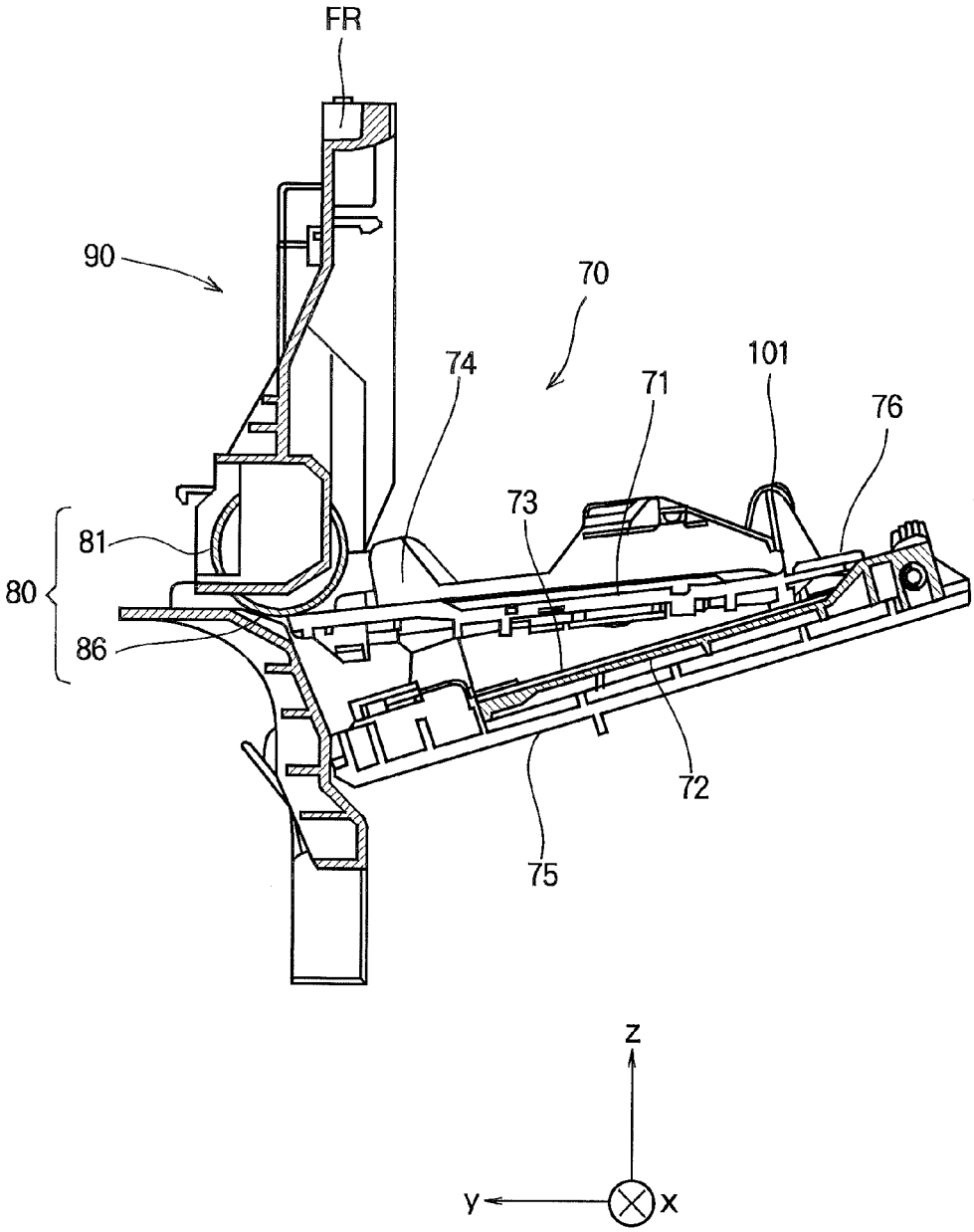
FIG. 27 is a cross-sectional view schematically showing structure of the second sheet-medium feed mechanism when the main tray is located at the sheet-medium feed position in the second embodiment.
Figure 28:
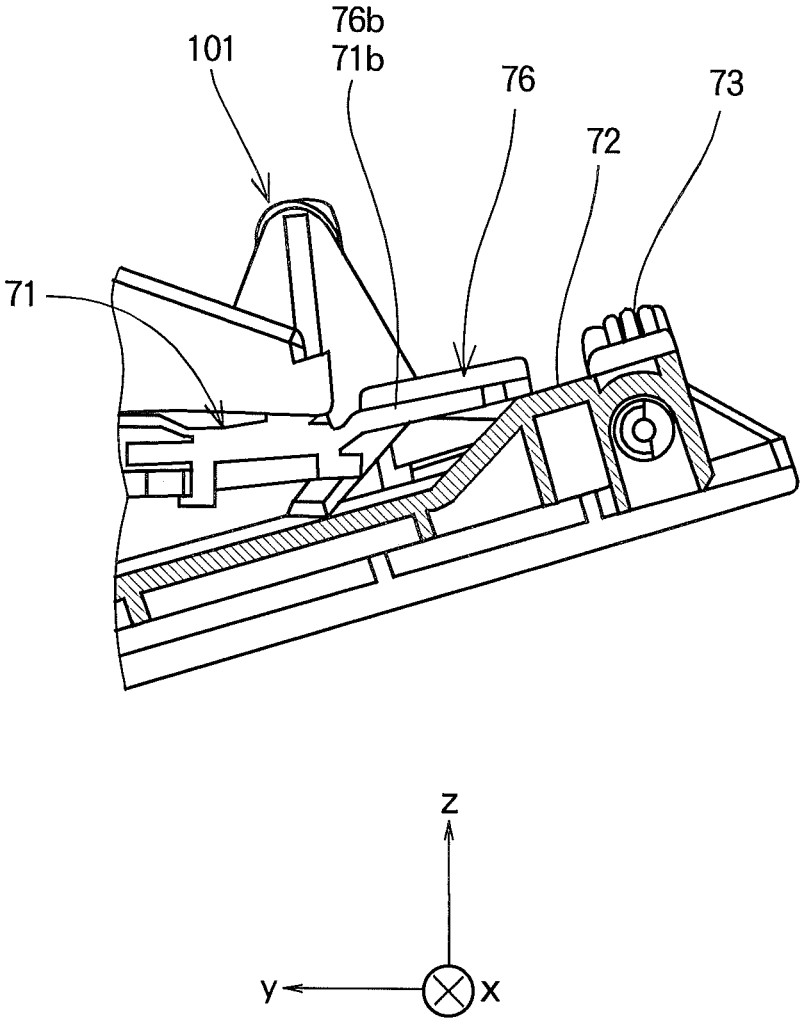
FIG. 28 is a cross-sectional view schematically showing a major part of the structure of the second sheet-medium feed mechanism when the main tray is located at the sheet-medium feed position in the second embodiment.
Figure 29:
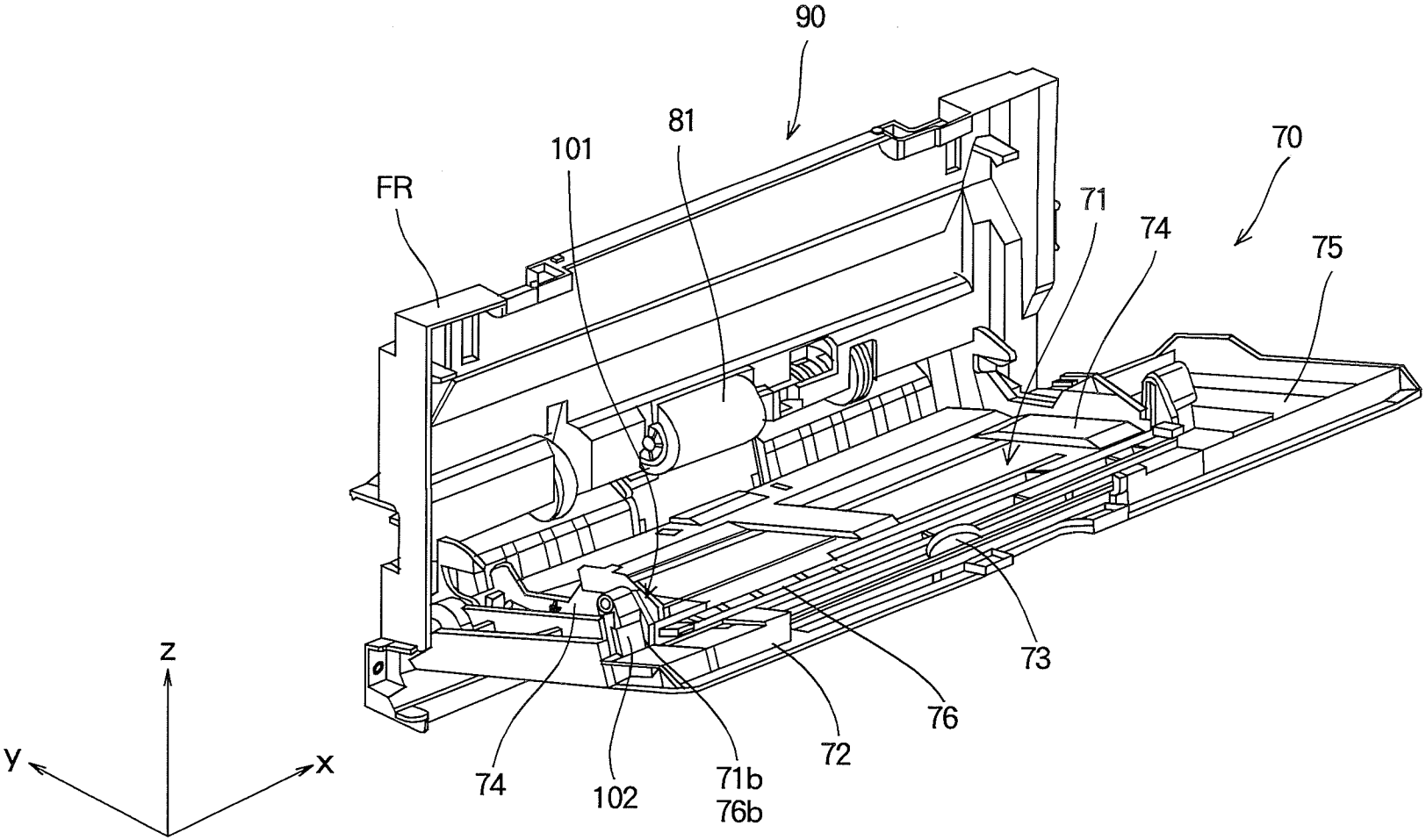
FIG. 29 is a perspective view schematically showing the structure of the second sheet-medium feed mechanism when the main tray is located at a depression position in the second embodiment.

FIG. 26 is a perspective view schematically showing structure of the second sheet-medium feed mechanism 90 when the main tray is located at the sheet-medium feed position in the second embodiment, FIG. 27 is a cross-sectional view schematically showing the structure of the second sheet-medium feed mechanism 90 when the main tray is located at the sheet-medium feed position in the second embodiment, and FIG. 28 is a cross-sectional view schematically showing a major part of the structure of the second sheet-medium feed mechanism 90 when the main tray is located at the sheet-medium feed position in the second embodiment. FIG. 29 is a perspective view schematically showing the structure of the second sheet-medium feed mechanism 90 when the main tray is located at the depression position in the second embodiment, FIG. 30 is a cross-sectional view schematically showing the second sheet-medium feed mechanism 90 when the main tray is located at the depression position in the second embodiment, and FIG. 31 is a cross-sectional view schematically showing a major part of the structure of the second sheet-medium feed mechanism 90 when the main tray is located at the depression position in the second embodiment.

In the second embodiment, each of boss supporting parts 101 as first shaft receiving parts is provided to be projected at both edges of the rear end part (backward end in the conveyance direction of the sheet medium 12*a*) of the main tray 71 as a sheet-medium stacker plate for stack of the sheet medium 12*a* and as a main sheet-medium stacker surface, and bosses 71*a* as first shafts are provided to be projected outward in the width direction A2 of the sheet-medium feed tray 70 as sheet-medium-output second sheet-medium conveying device and as a second sheet-medium supplier at the upper ends of the boss supporting parts 101. Upright shaft receiving parts 102 are provided to be projected at both edges of the rear end part of the exterior cover 75 as a holding member, and a shaft hole 75*a* is formed to be passed through the upper end of each shaft receiving part 102. Furthermore, when the bosses 71*a* are inserted into the associated shaft holes 75*a*, the main tray 71 is supported to the exterior cover 75 so as to be capable of being swung or rotated relative to the exterior cover 75.

Each of bosses 76*b* as third shafts projected outward in the width direction A2 of the sheet-medium feed tray 70 is provided at both edges of the front end part of the auxiliary stacker plate 76 as an auxiliary member. Furthermore, each of shaft holes 71*b* is passed through the lower ends of the boss supporting parts 101. When the bosses 76*b* are inserted into the associated shaft holes 71*b*, the auxiliary stacker plate 76 is supported to the main tray 71 so as to be capable of being swung or rotatable relative to the main tray 71.

Figure 30:
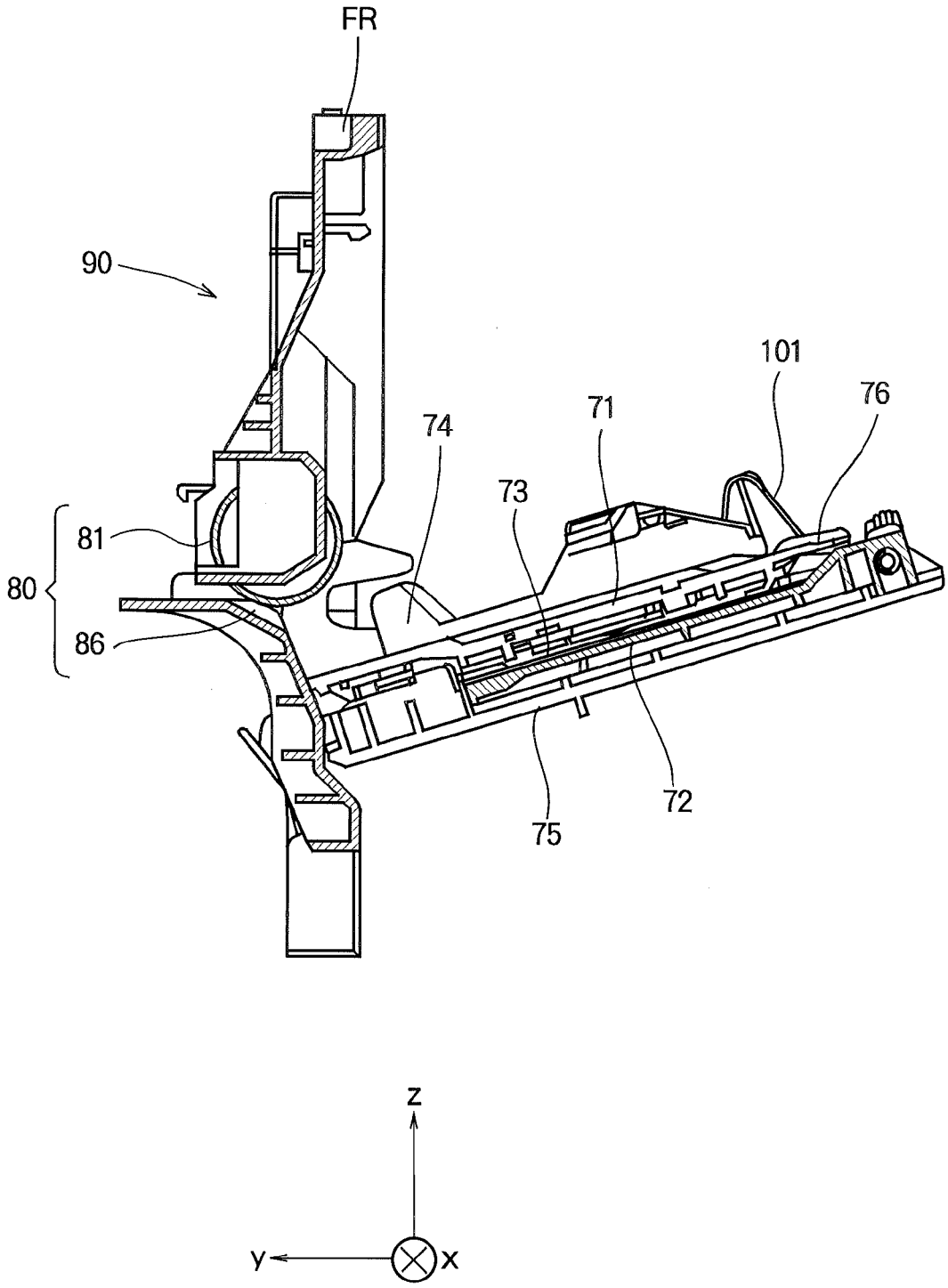
FIG. 30 is a cross-sectional view schematically showing the structure of the second sheet-medium feed mechanism when the main tray is located at the depression position in the second embodiment.
Figure 31:
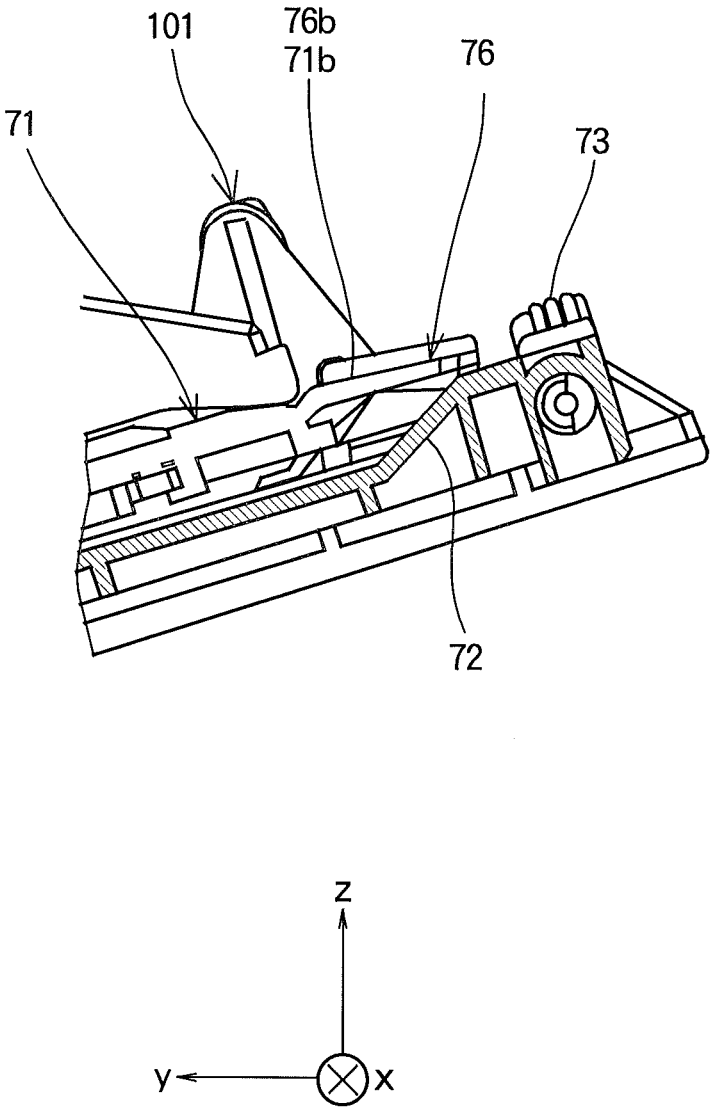
FIG. 31 is a cross-sectional view schematically showing a major part of the structure of the second sheet-medium feed mechanism when the main tray is located at the depression position in the second embodiment.

In this case, as the main tray 71 is swung to the exterior cover 75 to be located at the depression position shown by FIGS. 29 and 30 or at the sheet-medium feed position shown by FIGS. 26 and 27, the auxiliary stacker plate 76 linked with the first auxiliary tray 72 is swung or rotated together with the main tray 71.

Accordingly, even when the main tray 71 is located either at the depression position or at the sheet-medium feed position as shown in FIGS. 28 and 31, the gap portion between the rear end part of the upper surface of the main tray 71 and the front end part of the upper surface of the auxiliary stacker plate 76 in the depression position is equal to the gap portion between the rear end part of the upper surface of the main tray 71 and the front end part of the upper surface of the auxiliary stacker plate 76. Thus, under a condition that the main tray 71 is located at the sheet-medium feed position, the gap portion between the rear end part of the upper surface of the main tray 71 and the front end part of the upper surface of the auxiliary stacker plate 76 can be prevented from being larger.

As a result, it can be avoided that the front end of the sheet medium or media 12*a* stacked on the main tray 71 abuts against the lateral surface of the rear end part of the main tray 71 depending upon an angle of the sheet medium or media 12*a* relative to the upper surface of the main tray 71 when the sheet medium or media 12*a* are set in the sheet-medium feed tray 70. Thus, the sheet medium or media 12*a* can be prevented from being bent, buckled or damaged and can be smoothly set in the sheet-medium feed tray 70 by the user.

MODIFIED EXAMPLES

In the first and second embodiments, the cases where the sheet-medium conveying device is the sheet-medium feed tray 70 have been described. However, the present invention may be applied to another case where the sheet-medium conveying device is a sheet-medium output tray as a sheet-medium ejection mechanism.

Furthermore, in the first and second embodiments, the cases where the image forming apparatus is a color printer have been described. However, the present invention may be applied to other types of image forming apparatuses such as a photocopier, a facsimile and a Multifunction Peripheral (MFP).

The present invention is not limited to the aforementioned embodiments, but may be modified in various ways on the basis of the gist and spirit of the present invention.

What is claimed is:

1. A sheet-medium conveying device, comprising:

a first stacker part provided on a casing and being openable and closable relative to the casing, the first stacker part having a first stacker surface on which a sheet medium is to be placed;

a second stacker part provided on the first stacker part and being configured to be drawn from and slidable relative to the first stacker part substantially in parallel to the first stacker surface, the second stacker part having a second stacker surface on which the sheet medium is to be placed; and an auxiliary member provided on the first stacker part and being rotatable, the auxiliary member being engaged with the second stacker part so as to be rotated in conjunction with a sliding motion of the second stacker part substantially in parallel to the first stacker surface so that the auxiliary member covers a gap portion between the first stacker surface and the second stacker surface and is tilted relative to the second stacker surface in a state where the drawing of the second stacker part from the first stacker part has been completed.

2. The sheet-medium conveying device according to claim 1, wherein the first stacker part includes:

a main tray having the first stacker surface, and a holding member for holding the main tray, the main tray being openable from and closable relative to the casing.

3. The sheet-medium conveying device according to claim 2, wherein the auxiliary member is supported by the holding member.

4. The sheet-medium conveying device according to claim 2, wherein the auxiliary member is supported by the main tray.

5. The sheet-medium conveying device according to claim 1, wherein the sheet medium is conveyed in a first direction, and wherein the auxiliary member has a mark indicative of a position of the sheet medium in a second direction perpendicular to the first direction, the position being determined according to a size of the sheet medium.

6. An image forming apparatus, comprising:

the casing; and the sheet-medium conveying device of claim 1.

7. The sheet-medium conveying device according to claim 1, wherein a rear end part of the first stacker surface is lower than a front end part of the auxiliary member in a conveyance direction of the sheet medium.

8. The sheet-medium conveying device according to claim 1, wherein the auxiliary member is substantially parallel to the first stacker surface in a state where an inserting of the second stacker part into the first stacker part has been completed.

9. The sheet-medium conveying device according to claim 1, wherein in a state where the drawing of the second stacker part from the first stacker part has been completed, a rear end part of the auxiliary member is lower than a front end part of the auxiliary member in a conveyance direction of the sheet medium.

10. The sheet-medium conveying device according to claim 1, wherein:

the second stacker part includes a recess elongated in a second direction perpendicular to a first direction in which the sheet medium is conveyed; and the auxiliary member includes a projection, the projection advancing into the recess in the state where the drawing of the second stacker part from the first stacker part has been completed.

11. The sheet-medium conveying device according to claim 1, wherein:

the second stacker part includes a projection elongated in a conveyance direction of the sheet medium; and the auxiliary member includes a recess which the projection can advance into in the state where the drawing of the second stacker part from the first stacker part has been completed.

12. A sheet-medium conveying device, comprising:

a first stacker part provided on a casing and being openable from and closable relative to the casing, the first stacker part having a first stacker surface on which a sheet medium is to be placed;

a second stacker part provided on the first stacker part and being configured to be drawn from and slidable relative to the first stacker part substantially in parallel to the first stacker surface, the second stacker part having a second stacker surface on which the sheet medium is to be placed;

an auxiliary part that covers a gap portion between the first stacker surface and the second stacker surface; and a pair of guide parts arranged on the first stacker part and being movable within a moving range in a second direction perpendicular to a first direction in which the sheet medium is conveyed, the pair of guide parts regulating edges of the sheet medium which is placed on the first stacker surface, wherein a front end part of the second stacker part and a rear end part of the auxiliary part in the first direction form an overlap part throughout an entire range of opposing regions of the second stacker part and the auxiliary part, the opposing regions extending in the second direction and corresponding to the moving range of the pair of guide parts, in a state where the drawing of the second stacker part from the first stacker part has been completed, wherein the auxiliary part is tilted relative to the second stacker surface in the state where the drawing of the second stacker part from the first stacker part has been completed.

13. The sheet-medium conveying device according to claim 12, wherein:

the second stacker part includes a plurality of recesses provided on the front end part of the second stacker part and arranged in the second direction; and the auxiliary part includes a plurality of projections provided on the rear end part of the auxiliary part and arranged in the second direction, wherein the overlap part is formed by advancing each of the plurality of projections into each of the plurality of recesses correspondingly and respectively in the state where the drawing of the second stacker part from the first stacker part has been completed.

14. The sheet-medium conveying device according to claim 12, wherein a rear end part of the first stacker surface is lower than a front end part of the auxiliary part in the first direction.

15. The sheet-medium conveying device according to claim 12, wherein the auxiliary part includes a mark indicative of a stack location in the second direction, the stack location being determined by sizes of the sheet medium.

16. The sheet-medium conveying device according to claim 12, wherein the first stacker part includes:

a main tray having the first stacker surface; and a holding part for holding the main tray, the main tray being openable from and closable relative to the casing.

17. An image forming apparatus, comprising:

the casing; and the sheet-medium conveying device of claim 12.

* * * * *